US011292246B2

(12) United States Patent
Shindo

(10) Patent No.: US 11,292,246 B2
(45) Date of Patent: Apr. 5, 2022

(54) IMAGE RECORDING APPARATUS

(71) Applicant: BROTHER KOGYO KABUSHIKI KAISHA, Nagoya (JP)

(72) Inventor: Tatsuya Shindo, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/020,120

(22) Filed: Sep. 14, 2020

(65) Prior Publication Data

US 2021/0086502 A1 Mar. 25, 2021

(30) Foreign Application Priority Data

Sep. 24, 2019 (JP) ..... JP2019-172769

(51) Int. Cl.
*B41J 2/045* (2006.01)
*B41J 2/165* (2006.01)

(52) U.S. Cl.
CPC ..... *B41J 2/0451* (2013.01); *B41J 2/04536* (2013.01); *B41J 2/04571* (2013.01); *B41J 2/16526* (2013.01); *B41J 2002/16529* (2013.01)

(58) Field of Classification Search
CPC ... B41J 2/0451; B41J 2/04571; B41J 2/16579
See application file for complete search history.

(56) References Cited

U.S. PATENT DOCUMENTS

2007/0139461 A1 6/2007 Izuo
2008/0018691 A1 1/2008 Koase
2014/0300657 A1 10/2014 Ike
2017/0197407 A1* 7/2017 Karita ..... B41J 2/04535
2018/0215155 A1 8/2018 Iida
2019/0009547 A1 1/2019 Sasaki et al.

FOREIGN PATENT DOCUMENTS

JP 2003-118145 A 4/2003
JP 2010-030184 A 2/2010
JP 2010-039184 A 2/2010
JP 2011-167954 A 9/2011
JP 4929699 B2 5/2012
JP 5012182 B2 8/2012
JP 6231759 B2 11/2017
JP 2018-122506 A 8/2018
JP 2019-014155 A 1/2019

* cited by examiner

*Primary Examiner* — Scott A Richmond
(74) *Attorney, Agent, or Firm* — Baker Botts L.L.P.

(57) ABSTRACT

There is provided an image recording apparatus including: a conveyor; a head; a carriage; and a controller. The controller executes: recording of an image; in a case of performing recording of a same image continuously, recording of the same image, while making a setting to be a first setting; calculating of a total ejection amount; and presuming of a point of time at which each of the plurality of nozzles becomes an ejection-defective nozzle having defectiveness in ejection of the liquid. Further, in a case that the controller presumes that a certain nozzle, as any one of the plurality of nozzles, becomes the ejection-defective nozzle before the recording of the same image is completed, the controller changes, before the point of time, the setting to a second setting in which the total ejection amount of the certain nozzle is made greater than that in the first setting.

5 Claims, 12 Drawing Sheets

Fig. 5

| | | E | | | | |
|---|---|---|---|---|---|---|
| | | E<E1 | E1≦E<E2 | E2≦E<E3 | E3≦E<E4 | E≧E4 |
| T(°C) | ⋮ | ⋮ | ⋮ | ⋮ | ⋮ | ⋮ |
| | 18 | +0.2 | +0.1 | ±0 | -0.1 | -0.2 |
| | 19 | +0.3 | +0.2 | +0.1 | ±0 | -0.1 |
| | 20 | +0.4 | +0.3 | +0.2 | +0.1 | ±0 |
| | 21 | +0.5 | +0.4 | +0.3 | +0.2 | +0.1 |
| | ⋮ | ⋮ | ⋮ | ⋮ | ⋮ | ⋮ |

IMAGE RECORDING APPARATUS

CROSS REFERENCE TO RELATED APPLICATION

The present application claims priority from Japanese Patent Application No. 2019-172769, filed on Sep. 24, 2019, the disclosure of which is incorporated herein by reference in its entirety.

BACKGROUND

Field of the Invention

The present disclosure relates to an image recording apparatus which ejects a liquid from a nozzle so as to record an image on a recording medium.

Description of the Related Art

As an image recording apparatus which ejects a liquid from a nozzle so as to record an image on a recording medium, there is known an ink-jet printer which ejects an ink from a nozzle so as to record an image on paper sheet (paper). In this known ink-jet printer, in a case that recording is performed for a plurality of pages, a nozzle check is performed every time the recording for a predetermined number of pages is ended. Further, in a case that there is not less than a predetermined number of an ejection failure nozzle or unsatisfactory ejection nozzle is present, as a result of the nozzle check, a head cleaning is performed.

SUMMARY

In the known ink-jet printer as described above, in a case, for example, that a same image is recorded continuously on a plurality of paper sheets, using frequency of a specified nozzle is low in some cases. In such a situation, the specified nozzle of which usage frequency is low becomes an ejection-defective nozzle in which any defectiveness in ink ejection occurs, in some cases. Accordingly, it is useful to perform the nozzle check every time the recording for the predetermined number of pages is ended, as described above. Note that, however, performing the nozzle check and/or the head cleaning requires the time to some extent; thus, in a case that the nozzle check and/or the head cleaning is/are performed in the middle of (during) the recording, a time since a recording instruction (recording command) instructing the recording is input and until the recording is completed becomes long.

An object of the present disclosure is to provide an image recording apparatus capable of shortening, as much as possible, the time since the recording instruction is input and until the recording is completed, in a case that a same image is continuously recorded on a plurality of pieces of a recording medium.

According to an aspect of the present disclosure, there is provided an image recording apparatus including: a conveyor configured to convey a recording medium in a conveyance direction; a head in which a plurality of nozzles aligned in the conveyance direction are opened; a carriage mounting the head and configured to move in a scanning direction crossing the conveyance direction; and a controller configured to execute: recording of an image on the recording medium by performing a recording pass of causing the head to eject a liquid from the plurality of nozzles toward the recording medium while causing the carriage to move in the scanning direction, and a conveying operation of causing the conveyor to convey the recording medium in the conveyance direction; in a case of performing recording of a same image continuously on a plurality of pieces of the recording medium, performing the recording of the same image by setting allotment of the plurality of nozzles with respect to dots constructing the same image in the recording pass and a conveyance amount of the recording medium in the conveyance operation to a first setting; calculating, with respect to each of the plurality of nozzles, of a total ejection amount being a total of an ejection amount of the liquid from each of the plurality of nozzles in a case that the same image is recorded on one piece of the recording medium in the first setting; presuming, with respect to each of the plurality of nozzles, of a point of time at which each of the plurality of nozzles becomes an ejection-defective nozzle having defectiveness in ejection of the liquid, based on the calculated total ejection amount, and based on data regarding a relationship between the total ejection amount and change in viscosity of the liquid in each of the plurality of nozzles; and in a case that the controller presumes that a certain nozzle as any one of the plurality of nozzles becomes the ejection-defective nozzle before the recording of the same image with respect to all the plurality of pieces of the recording medium for which the recording is instructed is completed, changing the allotment of the plurality of nozzles and the conveyance amount of the recording medium to a second setting, before the point of time at which the certain nozzle is presumed to become the ejection-defective nozzle, the second setting being different from the first setting in the allotment of the plurality of nozzles with respect to the dots, which construct the same image, in the recording pass so as to make the total ejection amount of the certain nozzle to be greater than that in the first setting.

According to another aspect of the present disclosure, there is provided an image recording apparatus including: a head in which a plurality of nozzles are opened; and a maintenance section configured to perform a maintenance operation for recovering the plurality of nozzles; and a controller configured to execute: recording of an image on a recording medium by causing the head to eject a liquid from the plurality of nozzles toward the recording medium; causing of the maintenance section to perform the maintenance operation during the recording of the image on the recording medium; in a case of performing recording of a same image continuously on a plurality of pieces of the recording medium, calculating, with respect to each of the plurality of nozzles, of a total ejection amount being a total of an ejection amount of the liquid from each of the plurality of nozzles in a case that the same image is recorded on one piece of the recording medium; presuming, with respect to each of the plurality of nozzles, of whether or not each of the plurality of nozzles becomes an ejection-defective nozzle having defectiveness in ejection of the liquid before the recording of the same image with respect to all the plurality of pieces of the recording medium for which the recording is instructed is completed, based on the calculated total ejection amount and based on data regarding a relationship between the total ejection amount and change in viscosity of the liquid in each of the plurality of nozzles; and making of frequency of the maintenance operation to be performed, for a certain nozzle included in the plurality of nozzles and presumed to become the ejection-defective nozzle before the recording of the same image with respect to all the plurality of pieces of the recording medium for which the recording is instructed is completed, to be higher than that for another nozzle included in the plurality of nozzles and different from the certain nozzle.

According to still another aspect of the present disclosure, there is provided an image recording apparatus including: a head in which a plurality of nozzles are opened; a signal outputting circuit configured to output different signals with respect to each of the plurality of nozzles, the different signals depending on whether or not each of the plurality of nozzles is an ejection-defective nozzle having defectiveness in ejection of the liquid; and a controller configured to execute: recording of an image on a recording medium by causing the head to eject a liquid from the plurality of nozzles toward the recording medium; in a case of performing recording of a same image continuously on a plurality of pieces of the recording medium, calculating, with respect to each of the plurality of nozzles, of a total ejection amount being a total of an ejection amount of the liquid from each of the plurality of nozzles in a case that the same image is recorded on one piece of the recording medium; presuming, with respect to each of the plurality of nozzles, of a point of time at which each of the plurality of nozzles becomes the ejection-defective nozzle, based on the calculated total ejection amount and based on data regarding a relationship between the total ejection amount and change in viscosity of the liquid in each of the plurality of nozzles; and determining, with respect to a certain nozzle included in the plurality of nozzles and presumed to become the ejection-defective nozzle before the recording of the same image with respect to all the plurality of pieces of the recording medium for which the recording is instructed is completed, of whether or not the certain nozzle has actually become the ejection-defective nozzle based on a signal, included in the different signals, from the signal outputting circuit, before the point of time at which the certain nozzle is presumed to become the ejection-defective nozzle.

According to the present disclosure, in the case of performing of recording of the same image continuously on a plurality of pieces of the recording medium, it is possible to shorten, as much as possible, the time since the recording instruction is input and until the recording is completed.

BRIEF DESCRIPTION OF THE DRAWINGS

FIG. 5 is a view indicating a table associating a total ejection amount and temperature, and an increase amount in ink viscosity with one another.

DESCRIPTION OF THE EMBODIMENTS

First Embodiment

In the following, a first embodiment of the present disclosure will be explained.

<Overall Configuration of Printer>

Figure 1:
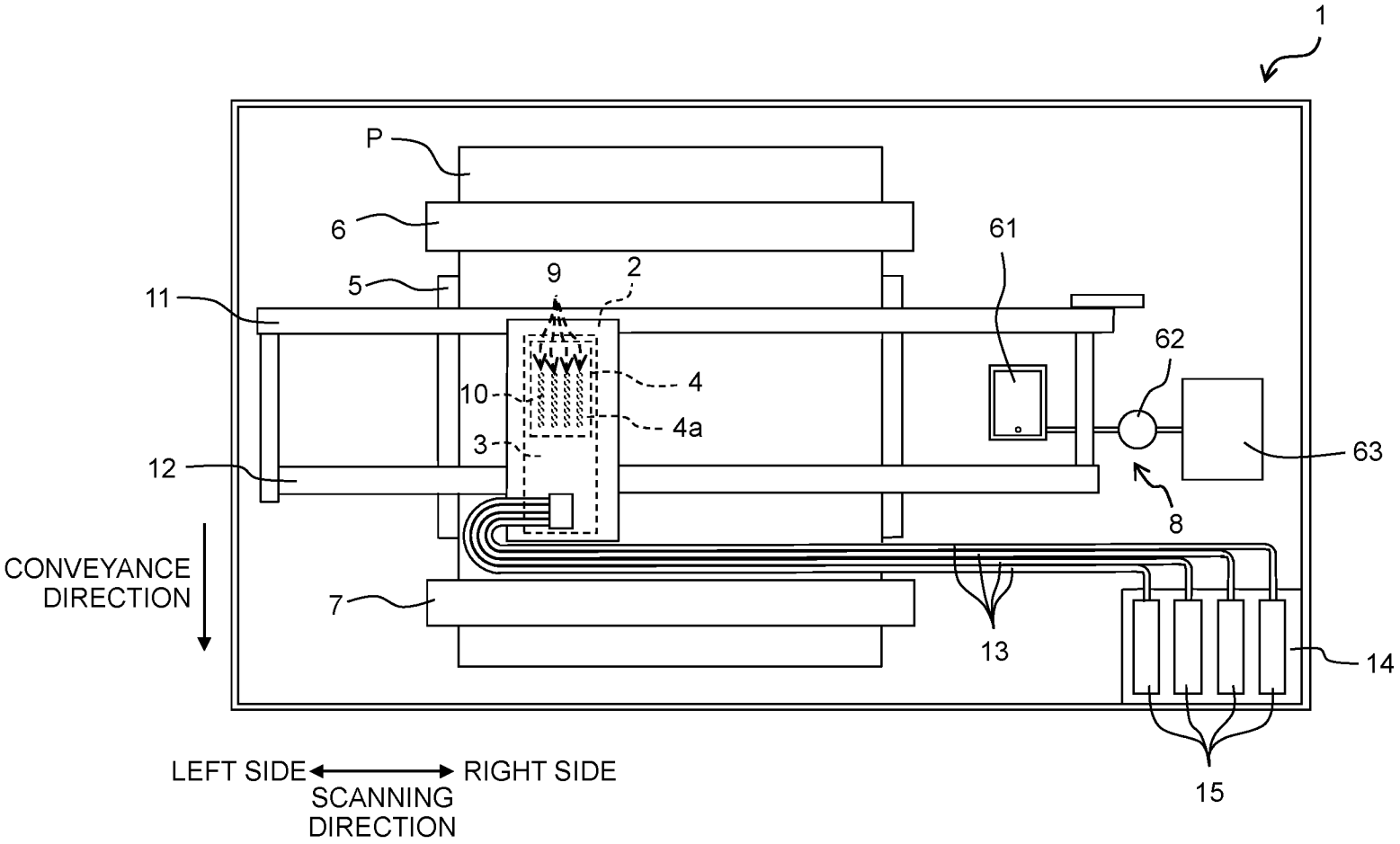
FIG. 1 is a view schematically depicting a configuration of a printer according to a first embodiment.

As depicted in FIG. 1, a printer 1 (corresponding to an "image recording apparatus" of the present disclosure) according to the first embodiment is provided with carriage 2, a sub tank 3, an ink-jet head 4 (corresponding to a "head" of the present disclosure), a platen 5, conveyance rollers 6 and 7, a maintenance unit 8, etc.

The carriage 2 is supported by two guide rails 11 and 12 extending in a scanning direction. The carriage 2 is connected to a carriage motor 86 (see FIG. 2) via a non-depicted belt, etc.; in a case that the carriage motor 86 is driven, the carriage 2 moves in the scanning direction along the guide rails 11 and 12. Note that in the following explanation, the right side and the left side in the scanning direction will be defined as depicted in FIG. 1.

The sub tank 3 is attached to or mounted on the carriage 3. In this case, a cartridge holder 14 is provided on the printer 1, and four ink cartridges 15 are detachably installed in the cartridge holder 14. Black, yellow, cyan, and magenta inks (each corresponding to a "liquid" of the present disclosure) are stored in the four ink cartridges 15, respectively, in this order from an ink cartridge 15, among the four ink cartridges 15, arranged on the right side in the scanning direction. The sub tank 3 is connected to the four ink cartridges 15 installed in the cartridge holder 14 via four tubes 13, respectively. With this, the four color inks are supplied from the four ink cartridges 15 to the sub tank 3.

The ink-jet head 4 is attached to the carriage 2, and is connected to a lower end part of the sub tank 3. The four color inks are supplied to the ink-jet head 4 from the sub tank 3. Further, the ink-jet head 4 has four nozzle rows 9 formed in a nozzle surface 4*a* which is a lower surface of the ink-jet head 4. The four nozzle rows 9 are arranged side by side in the scanning direction. The four nozzle rows 9 correspond to the four color inks, respectively. Specifically, the four nozzle rows 9 correspond to the black, yellow, cyan, and magenta inks from a nozzle row 9, among the four nozzle rows 9, which is arranged on the right side in the scanning direction. Each of the four nozzle rows 9 has a plurality of nozzles 10 aligned in a conveyance direction which is orthogonal to the scanning direction.

The platen 5 is arranged at a position below or under the ink-jet head 4 and faces (is opposite to) the plurality of nozzles 10. The platen 5 extends in the scanning direction over the entire length of recording paper P (example of a "recording medium" of the present disclosure) and supports the recording paper P from therebelow. The conveyance roller 6 is arranged on the upstream side in the conveyance direction with respect to the ink-jet head 4 and the platen 5. The conveyance roller 7 is arranged on the downstream side in the conveyance direction with respect to the ink-jet head 4 and the platen 5. The conveyance rollers 6 and 7 are connected to a conveying motor 87 (see FIG. 2) via nonillustrated gears, etc. In a case that the conveying motor 87 is driven, the conveyance rollers 6 and 7 are rotated so as to convey the recording paper P in the conveyance direction.

The maintenance unit 8 is provided with a cap 61, a suction pump 62 and a waste liquid tank 63. The cap 61 is arranged on the right side in the scanning direction relative to the platen 5. Further, in a case that the carriage 2 is positioned at a maintenance position located on the right side in the scanning direction relative to the platen 5, the plurality of nozzles 10 face (are opposite to) the cap 61.

Further, the cap 61 is capable of being raised and lowered (ascended/descended, moving in the up/down direction) by a cap ascending/descending mechanism 88 (see FIG. 2); in a case that the cap 61 is raised by the cap ascending/descending mechanism 88 in a state that the carriage 2 is positioned at the maintenance position and that the plurality of nozzles 10 are made to face the cap 61, an upper end part of the cap 61 makes tight contact with the nozzle surface 4*a* of the ink-jet head 4 so as to cover the plurality of nozzles 10 with the cap 61. Note that the cap 61 is not limited to or restricted by being a cap which makes tight contact with the nozzle surface 4*a* to thereby cover the plurality of nozzles 10. The cap 61 may be, for example, configured to make tight contact with a non-depicted frame, etc., which is arranged to surround the nozzle surface 4*a* of the ink-jet head 4, to thereby cover the plurality of nozzles 10.

The suction pump 62 is, for example, a tube pump, etc., and is connected to the cap 61 and the waste liquid tank 63. Further, in the maintenance unit 8, in a case that the suction pump 62 is driven in a state that the plurality of nozzles 10 are covered by the cap 61 as described above, it is possible to perform a so-called suction purge wherein the ink inside the ink-jet head 4 is discharged from the plurality of nozzles 10. The ink discharged from the ink-jet head 4 is stored in the waste liquid tank 63.

Note that although the explanation has been made, for the sake of convenience, about a case that the cap 61 covers all the plurality of nozzles 10 in a collective manner, and that the ink inside the ink-jet head 4 is discharged from all the plurality of nozzles 10, the present disclosure is not limited to this case. For example, it is also allowable that the cap 61 is provided with a part covering nozzles 10 which are included in the plurality of nozzles 10 and which construct the rightmost nozzle row 9 ejecting the black ink, and another part separate from the part and covering nozzles 10 which are included in the plurality of nozzles 10 and which construct the remaining left-side three nozzle rows 9 ejecting color inks (yellow, cyan and magenta ink), respectively. Further, it is allowable to provide such a configuration that is capable of, in the suction purge, selectively discharging either one of the black ink and the color inks in the ink-jet head 4. Alternatively, it is allowable, for example, that the cap 61 is provided as caps 61 corresponding to the four nozzle rows 9, respectively. Further, it is allowable to provide such a configuration that is capable of allowing, in the suction purge, the ink to be discharged independently from the nozzles 10 of each of the nozzle rows 9 and into one of the caps 61 corresponding thereto.

<Electrical Configuration of Printer>

Figure 2:
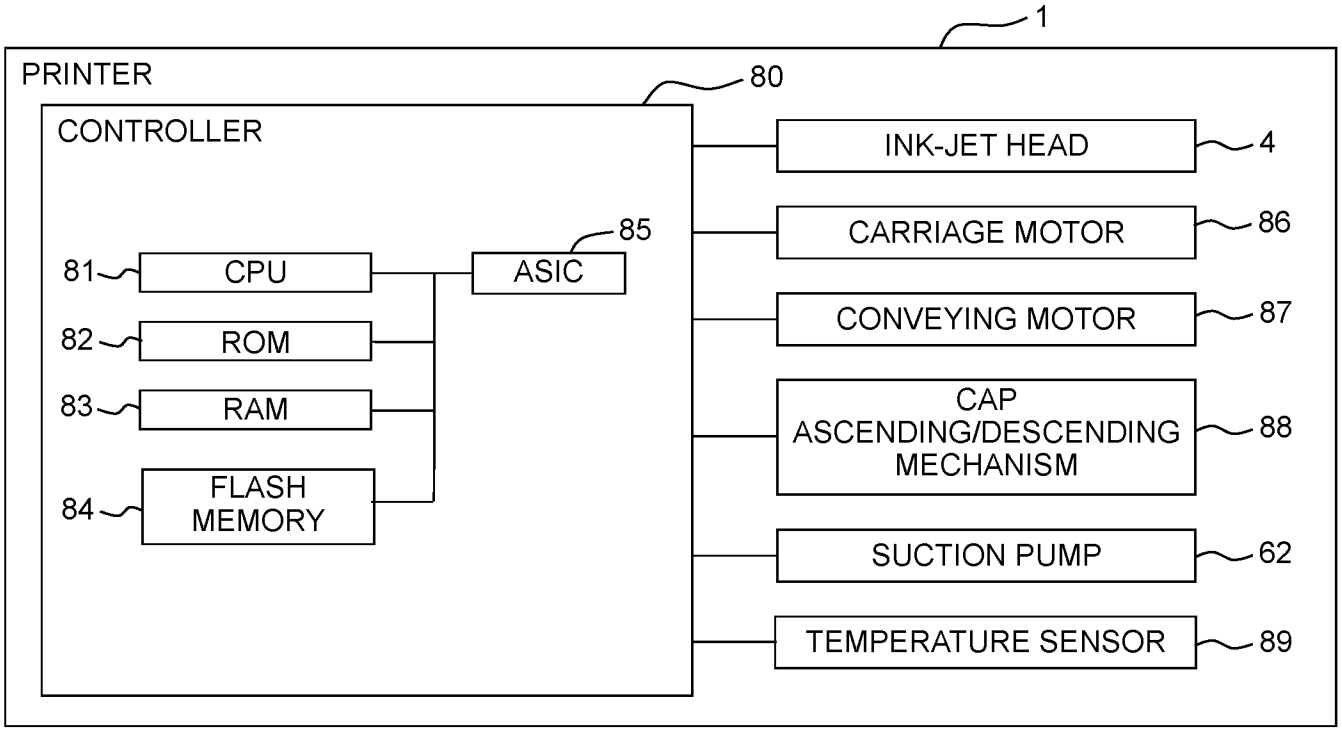
FIG. 2 is a block diagram depicting the electrical configuration of the printer.

Next, an explanation will be given about the electrical configuration of the printer 1. The operation of the printer 1 is controlled by a controller 80. As depicted in FIG. 2, the controller 80 includes a CPU (Central Processing Unit) 81, a ROM (Read Only Memory) 82, a RAM (Random Access Memory) 83, a flash memory 84, an ASIC (Application Specific Integrated Circuit) 85, etc., and these components or elements control the ink-jet head 4, the carriage motor 86, the conveying motor 87, the cap ascending/descending mechanism 88, the suction pump 62, etc. Further, the printer 1 is also provided with a temperature sensor 89, in addition to the above-described configuration. The temperature sensor 89 is configured to detect a temperature T around the printer 1, and to transmit a signal indicating the temperature T to the controller 80.

Note that in the controller 80, it is allowable that only the CPU 81 performs the respective processings. Alternatively, it is allowable that only the ASIC 85 performs the respective processings, or that the CPU 81 and the ASIC 85 perform the respective processing in a cooperative manner. Still alternatively, in the controller 80, it is allowable that one CPU 81 singly performs the respective processing, or that a plurality of pieces of the CPU 81 perform the processings in a sharing manner. Alternatively, in the controller 80, it is allowable that one ASIC 85 singly performs the respective processing, or that a plurality of pieces of the ASIC 85 perform the processings in a sharing manner.

<Control During Recording>

Next, an explanation will be given about a processing performed in the printer 1 in a case of recording an image on recording paper P. In the case of performing recording on the recording paper P, the controller 80 performs the processing in accordance with the flow depicted in FIG. 3A. The flow of FIG. 3A is started in a case that a recording instruction (recording command) to instruct the recording of an image on the recording paper P is input to the printer 1.

Figure 3A:
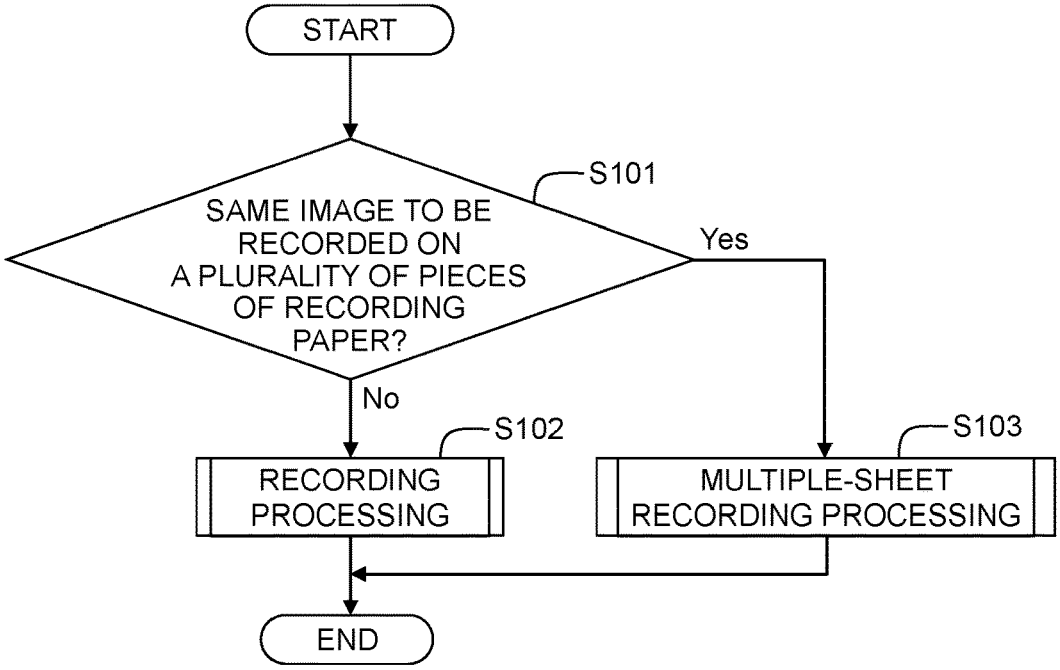
FIG. 3A is a flow chart depicting the flow of processing during recording.

As depicted in FIG. 3A, in a case that the recording instruction is input, the controller 80 determines, based on the recording instruction, whether or not a same image corresponding to image data input together with the recording instruction is to be continuously recorded on a plurality of pieces of the recording paper P (step S101). In a case that the same image is to be recorded only on one piece (one sheet) of the recording paper P (step S101: NO), the controller 80 executes the recording processing (step S102).

Figure 3B:
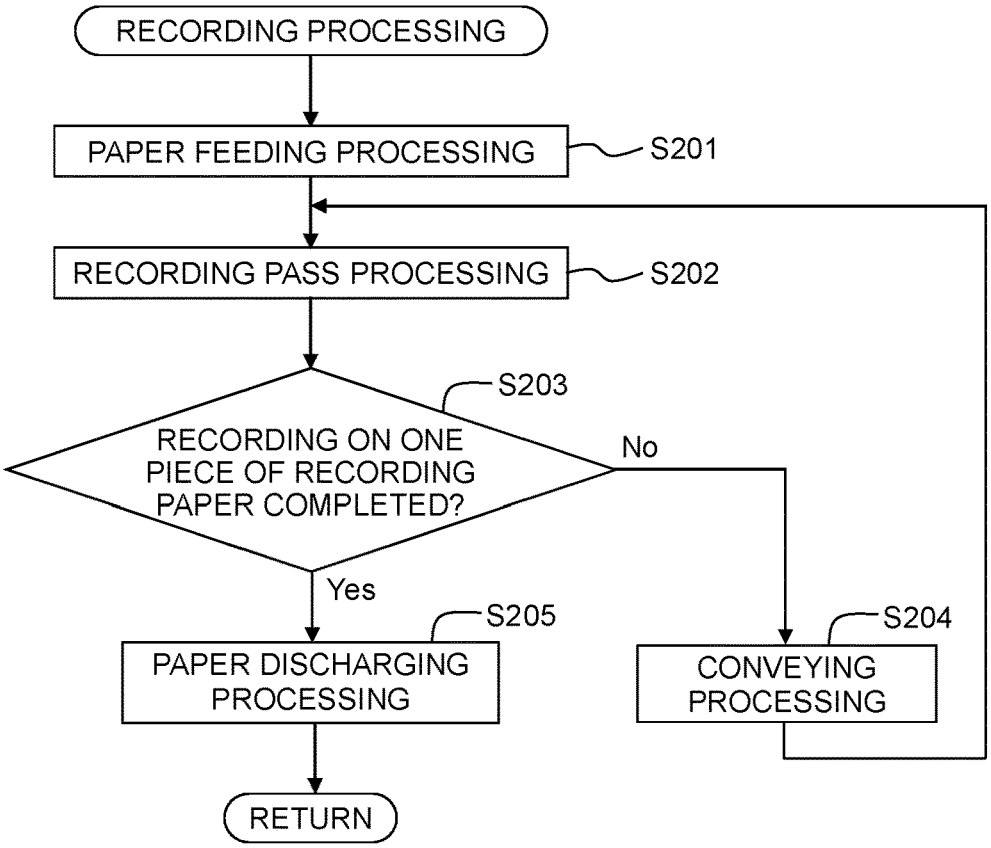
FIG. 3B is a flow chart depicting the flow of a printing processing of FIG. 3A.

In the recording processing in step S102, as depicted in FIG. 3B, the controller 80 firstly executes a paper feeding processing (step S201). In the paper feeding processing, the controller 80 controls a non-depicted paper feeding mechanism and the conveying motor 87 to thereby cause the paper feeding mechanism and the conveying roller 6 to perform feeding (supplying) of the recording paper P.

Next, the controller 80 executes a recording pass processing (step S202). In the recording pass processing, the controller 80 controls the ink-jet head 4 so as to eject the ink from the plurality of nozzles 10 toward the recording paper P, while controlling the carriage motor 86 so as to move the carriage 2 in the scanning direction.

Next, in a case that the recording of the same image with respect to one piece of the recording paper P is not completed (step S203: NO), the controller 80 executes a conveying processing (step S204). In the conveying processing, the controller 80 controls the conveying motor 87 so as to cause the conveying rollers 6 and 7 to convey the recording paper P. Then, after the conveying processing, the controller 80 returns to the processing of step S202.

In a case that the recording of the same image with respect to one piece of the recording paper P is completed (step S203: YES), the controller 80 executes a paper discharging processing (step S205). In the paper discharging processing, the controller 80 controls the conveyance motor 87 so as to cause the conveying rollers 6 and 7 to discharge the recording paper P. Then, after the paper discharging processing, the controller 80 returns to the flow of FIG. 3A, and ends the processing.

Figure 4A:
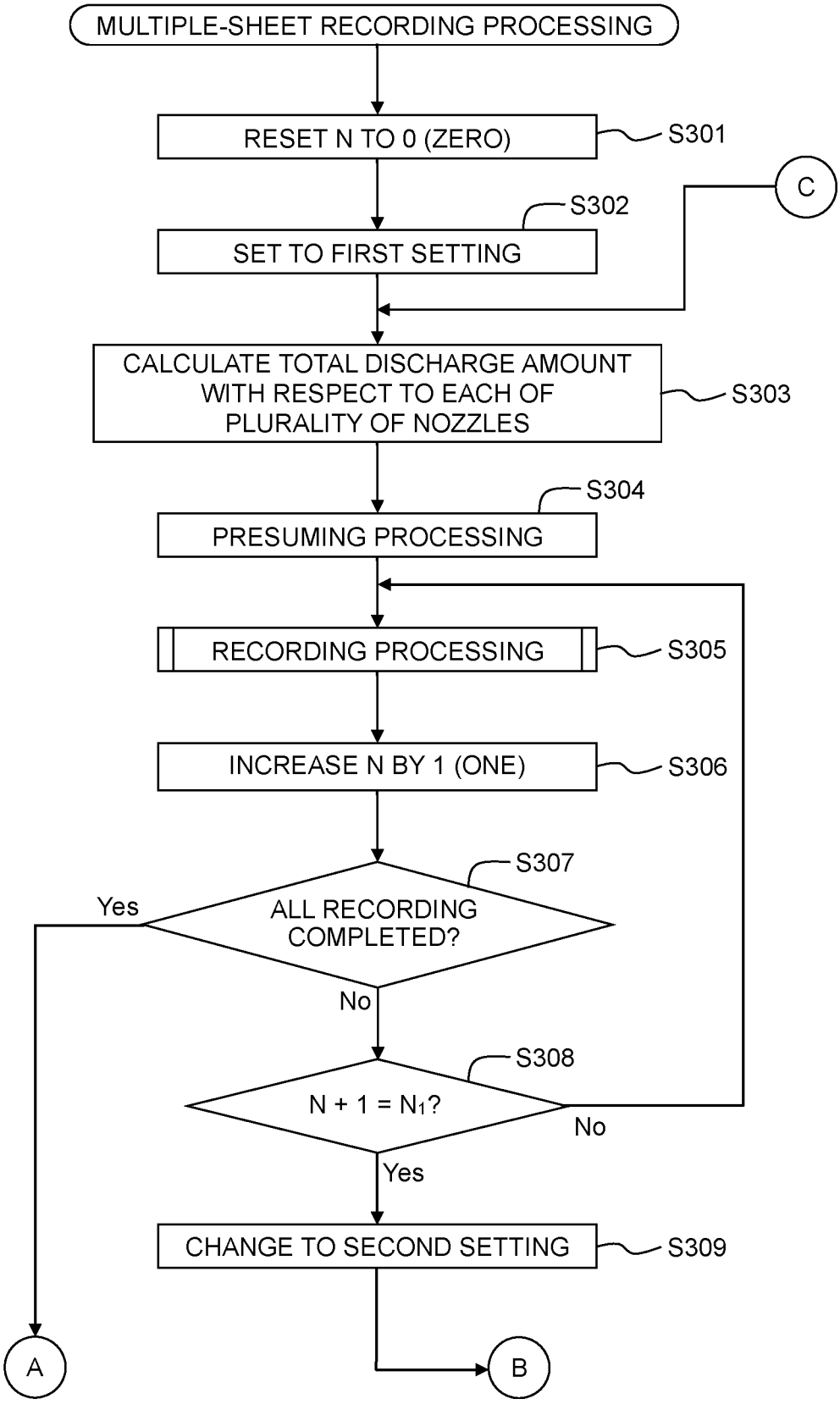
FIGS. 4A and 4B depict flow charts depicting the flow of a multiple-sheet recording processing of FIG. 3A.
Figure 4B:
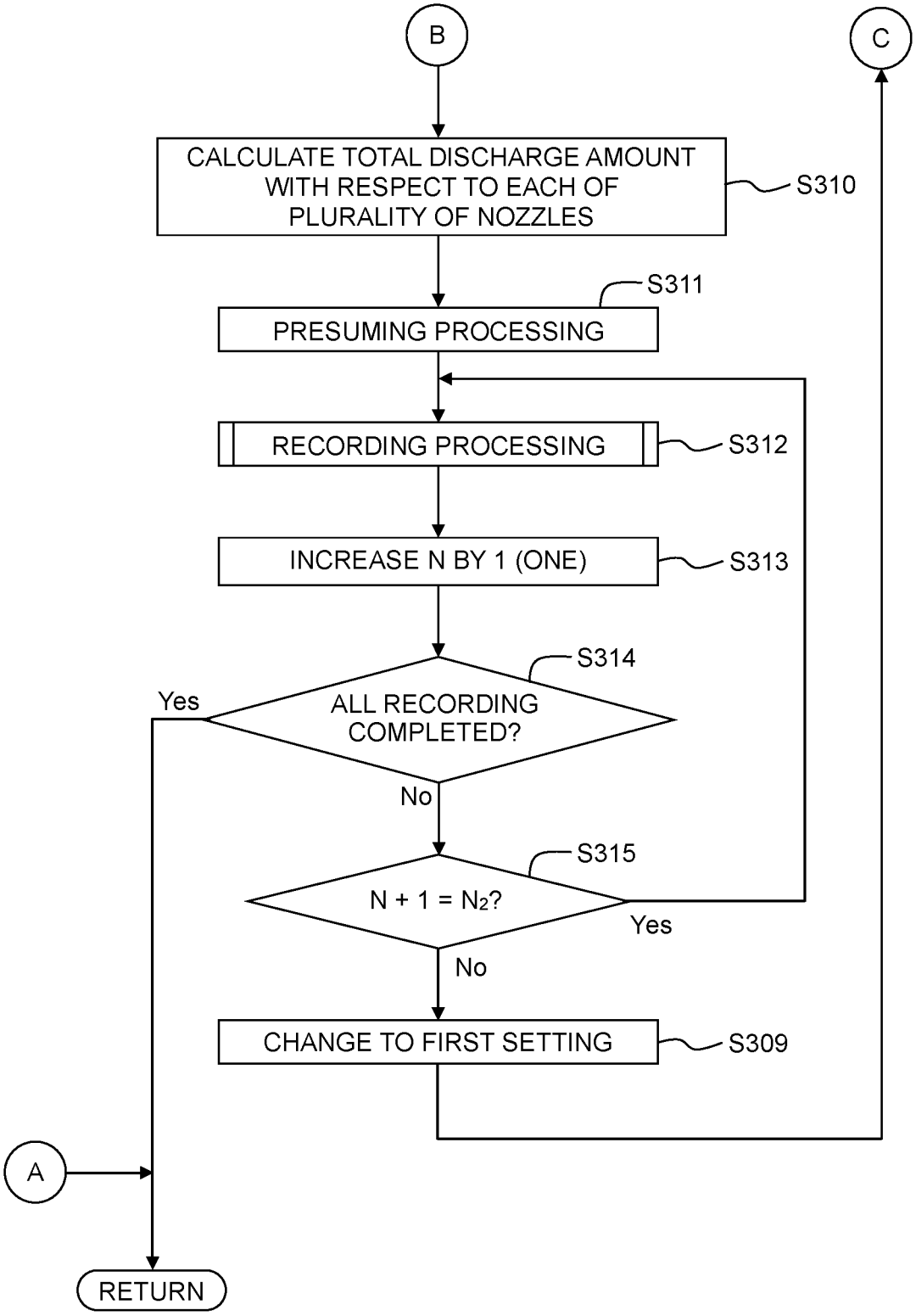

On the other hand, in a case that the same image is to be continuously recorded on a plurality of pieces (sheets) of the recording paper P (step S101: YES), the controller 80 executes a multiple-sheet recording processing (step S103). In the multiple-sheet recording processing of step S103, as depicted in FIGS. 4A and 4B, the controller 80 firstly resets a variable N to 0 (zero) (step S301). The variable N corresponds to a number of piece(s) (sheet(s)) of the recording paper P for which the recording has been completed.

Next, the controller 80 makes a setting, regarding allotment of the plurality of nozzles 10 with respect to dots constructing an image to be recorded in the recording pass (for example, in the case, the same image) and regarding a conveyance amount of the recording paper P, to be a first setting (step S302). Note that in the following description, the "setting, regarding allotment of the plurality of nozzles 10 with respect to dots constructing an image to be recorded in the recording pass and regarding a conveyance amount of the recording paper P" is referred to as a "allotment setting", in some cases. Next, the controller 80 calculates, with respect to each of the plurality of nozzles 10, a total ejection amount E which is a total of an ejection amount of the ink ejected from each of the plurality of nozzles 10 in the case that the image (same image) is recorded on one piece of the recording paper P in the first setting (step S303).

Next, the controller 80 executes a presuming processing (step S304). Here, as the total ejection amount E is greater, the ink inside each of the plurality of nozzles 10 is more likely to be replaced easily due to the ejection of the ink, and thus the ink inside each of the plurality of nozzles 10 is less likely to become highly viscous. Further, as the temperature T is lower, the moisture in the ink inside each of the plurality of nozzles 10 is less likely to evaporate, and thus the ink inside each of the plurality of nozzles 10 is less likely to become highly viscous. In the first embodiment, the flash memory 84 stores, for example, data of a table in which the total ejection amount E and the temperature T are associated with a change amount of the change in viscosity of the ink in each of the plurality of nozzles 10 in a period of time during which the image (same image) is recorded on one piece of the recording paper P, as depicted in FIG. 5. Here, in the change amount of the viscosity as indicated in FIG. 5, a "+" value indicates that the viscosity is increased, a "-" value indicates that the viscosity is lowered, and a "±" value indicates that the viscosity is not changed. Note that in the first embodiment, the data of the table corresponds to "data regarding the relationship between the total ejection amount and the change in viscosity of the liquid in each of the plurality of nozzles" of the present disclosure.

In the presuming processing, the controller 80 presumes, with respect to each of the plurality of nozzles 10, a point of time at which each of the plurality of nozzles 10 becomes an ejection-defective nozzle having defectiveness, based on: the total ejection amount E calculated in the processing of step S303, the temperature T obtained based on the signal from the temperature sensor 89, and the data of the table as described above. For example, the controller 80 calculates, regarding each of the plurality of nozzles 10, a number M which is a minimum natural number in such a case that a natural number multiple of an amount of increase (increase amount) in the viscosity corresponding to the total ejection amount E and the temperature T in the table of FIG. 5 exceeds a threshold value. In such a case, the controller 80 presumes that a certain nozzle 10 of, or each of, the plurality of nozzles 10, is presumed to become the ejection-defective nozzle during recording of an image on an M-th piece of the recording paper P. Note that in the following description, an explanation will be given about such a case that a certain nozzle 10, of the plurality of nozzles 10, which is presumed to become the ejection-defective nozzle fastest among the plurality of nozzles 10 in the first setting, is presumed to become the ejection-defective nozzle during the recording of the same image on a $N_1$-th piece of the recording paper P.

Next, the controller 80 executes, in the first setting, a recording processing which is similar to the multiple-sheet recording processing of step S103 so as to record the same image on one piece of the recording paper P (step S305); and the controller 80 increases the variable N by 1 (one) after the completion of the recording processing (step S306). Subsequently, the controller 80 determines whether or not the recording of the same image with respect to all the plurality of pieces of the recording paper P for which the recording is instructed is completed (step S307). In a case that the recording of the same image with respect to all the plurality of pieces of the recording paper P is completed (step S307: YES), the controller 80 returns to the flow of FIG. 3A, and ends the processing.

In a case that the recording of the same image with respect to all the plurality of pieces of the recording paper P is not completed (step S307: NO), the controller 80 determines whether or not a value [N+1] equals to $N_1$ (step S308). Namely, the controller 80 determines whether or not any one of the plurality of nozzles 10 is presumed to become the ejection-defective nozzle during the recording of the same image on next piece of the recording paper P. In a case that the value [N+1] is smaller than $N_1$ (step S308: NO), the controller 80 returns to the processing of step S305. In a case that the value [N+1] equals to $N_1$ (step S308: YES), the controller 80 changes the allotment setting to a second setting (step S309). In the second setting, the plurality of nozzles 10 are allotted with respect to the dots constructing the image to be recorded in the recording pass so that the total ejection amount E of a certain nozzle 10, of the plurality of nozzles 10, which is presumed to become the ejection-defective nozzle fastest among the plurality of nozzles 10 in the first setting becomes greater than the total ejection amount E in the first setting. Further, in the second setting, for example, the conveyance amount of the recording paper P in the conveyance operation performed firstly (first conveyance operation) is smaller than that in the first setting; and the conveyance amount of the recording paper P in the conveyance operation performed thereafter (after the first conveyance operation) is same as that in the first setting.

Next, the controller 80 calculates, with respect to each of the plurality of nozzles 10, the total ejection amount E in the second setting, based on the image data (step S310). Subsequently, the controller 80 executes the presuming processing (step S311). In the presuming processing, the controller 80 presumes, with respect to each of the plurality of nozzles 10, the point of time at which each of the plurality of nozzles 10 becomes the ejection-defective nozzle, based on: the total ejection amount E calculated in step S310, the temperature obtained based on: the signal from the temperature sensor 89, and the data of the table stored in the flash memory 84. Note that in the following description, an explanation will be given about such a case that a certain nozzle 10, of the plurality of nozzles 10, which is presumed to become the ejection-defective nozzle fastest among the plurality of nozzles 10 in the second setting is presumed to become the ejection-defective nozzle during the recording of the same image on a $N_2$-th piece of the recording paper P.

Next, the controller 80 executes, in the second setting, a recording processing which is similar to that in step S103 so as to record the same image on one piece of the recording paper P (step S312); and the controller 80 increases the variable N by 1 (one) after the completion of the recording processing (step S313). Subsequently, the controller 80 determines whether or not the recording of the same image with respect to all the plurality of pieces of the recording paper P for which the recording is instructed is completed (step S314). In a case that the recording of the same image with respect to all the plurality of pieces of the recording paper P is completed (step S314: YES), the controller 80 returns to the flow of FIG. 3A, and ends the processing.

In a case that the recording of the same image with respect to all the plurality of pieces of the recording paper P is not completed (step S314: NO), the controller 80 determines whether or not the value [N+1] equals to $N_2$ (step S315). Namely, the controller 80 determines whether or not any one of the plurality of nozzles 10 is presumed to become the ejection-defective nozzle during the recording of the same image on next piece of the recording paper P. In a case that the value [N+1] is smaller than $N_2$ (step S315: NO), the controller 80 returns to the processing of step S312. In a case that the value [N+1] equals to $N_1$ (step S315: YES), the controller 80 changes the allotment setting to the first setting (step S316), and returns to the processing of step S303.

Technical Effects of the First Embodiment

In a case the recording of the same image is performed continuously on a plurality of pieces of the recording paper P without changing the allotment setting, a state that the using frequency is low is maintained for a long period of time in a specific nozzle 10 among the plurality of nozzles 10, which in turn causes the specific nozzle 10 to become the ejection-defective nozzle, in some cases. In view of such a situation, in the first embodiment, in such a case that the same image is recorded continuously on a plurality of pieces of the recording paper P in the first setting, the controller 80 calculates the total ejection amount E in the first setting, with respect to each of the plurality of nozzles 10. Further, the controller 80 presumes the point of time at which each of the plurality of nozzles 10 becomes the ejection-defective nozzle, based on the calculated total ejection amount E and the data of the above-described table. There is such a case that the controller 80 presumes that any one of (for example, a certain nozzle included in) the plurality of nozzles becomes the ejection-defective nozzle before the recording of the same image with respect to all the plurality of pieces of the recording paper P for which the recording is instructed is completed. In this case, the controller 80 changes the allotment setting to the second setting in which the total ejection amount E of the certain nozzle, as any one of the plurality of nozzles 10 is greater than that in the first setting, before the point of time at which the certain nozzle, as any one of the plurality of nozzles 10 is presumed to become the ejection-defective nozzle. In the second setting, the allotment of the plurality of nozzles 10 with respect to the dots, which construct the same image, in the recording pass is different from that in the first setting. With this, the allotment of the plurality of nozzles 10, for recording the same image, with respect to the dots constructing the same image in the recording pass is changed. With this, the using frequency of a nozzle 10, among the plurality of nozzles 10, which is low in the first setting becomes high in the second setting, and thus such a nozzle 10 is less likely to become the ejection-defective nozzle. As a result, there is no need to perform, for example, the suction purge for recovering the nozzles 10, thereby making it possible to shorten, as much as possible, the time since the recording instruction is input and until the recording is completed.

On the other hand, in a case that the controller 80 changes the allotment setting to the second setting, although the using frequency of a nozzle 10, included in the plurality of nozzles 10, which has been low during the printing of the image in the first setting becomes high, the using frequency of another nozzle 10 becomes low. In view of such a situation, in the first embodiment, in a case that the controller 80 changes the allotment setting to the second setting, the controller 80 calculates the total ejection amount E in the second setting with respect to each of the plurality of nozzles 10. Then, the controller 80 presumes the point of time at which each of the plurality of nozzles 10 becomes the ejection-defective nozzle in the second setting, based on the calculated total ejection amount E and the data of the above-described table. Further, there is such a case that the controller 80 presumes that any one of (for example, a certain nozzle included in) the plurality of nozzles becomes the ejection-defective nozzle before the recording of the same image with respect to all the plurality of pieces of the recording paper P for which the recording is instructed is completed. In this case, the controller 80 changes the allotment setting to the first setting, as another setting, before the point of time at which the certain nozzle as any one of the plurality of nozzles 10 is presumed to become the ejection-defective nozzle. In the first setting, the allotment of the plurality of nozzles 10 with respect to the dots, which construct the same image in the recording pass is different from that in the second setting. With this, the allotment of the plurality of nozzles 10, for recording the same image, with respect to the dots constructing the same image in the recording pass is changed, thereby raising the using frequency of a nozzle 10, among the plurality of nozzles 10, which is low in the second setting becomes high in the first setting. As a result, there is no need to perform, for example, the suction purge for recovering the nozzles 10, thereby making it possible to shorten, as much as possible, the time since the recording instruction is input and until the recording is completed.

Note that in this case, the allotment setting which is changed from the second setting in the processing of step S316 is the first setting. Accordingly, in a case that the allotment setting is changed to the first setting, although the using frequency of a certain nozzle 10, among the plurality of nozzles 10, of which has been low in the initial first setting becomes low again, the using frequency of the certain nozzle 10 has become high in the second setting. Accordingly, the certain nozzle 10 of which using frequency becomes low in the first setting is less likely to become the ejection-defective nozzle, as compared with another case wherein the same image is continuously recorded (on the plurality of pieces of the recording paper P) in the first setting, without changing the allotment setting to the second setting during the recording.

Second Embodiment

Figure 6:
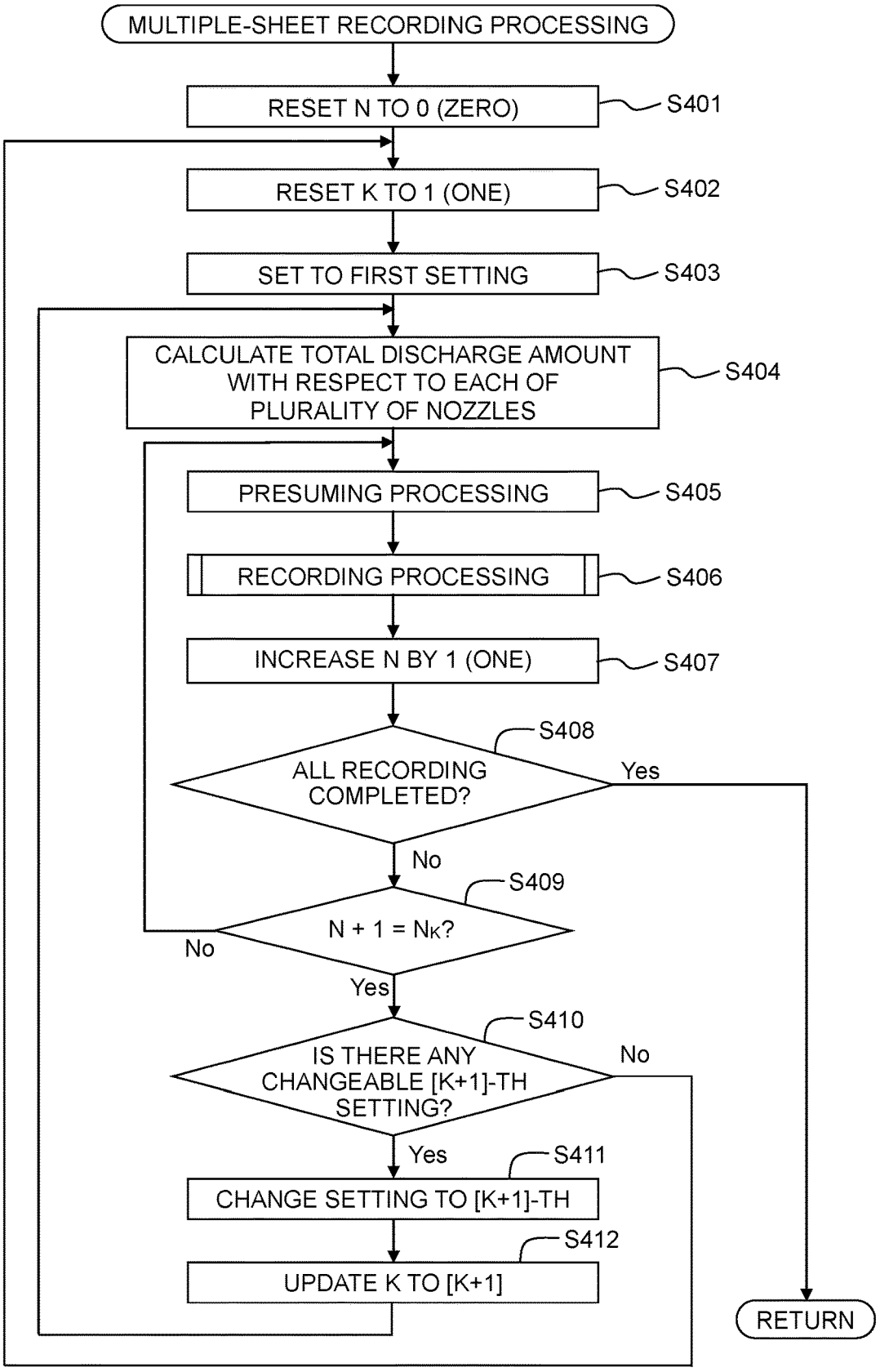
FIG. 6 is a flow chart depicting the flow of the multiple-sheet recording processing in a second embodiment.

Next, a second embodiment of the present disclosure will be explained. The second embodiment is different from the first embodiment, in view of the flow of the multiple-sheet recording processing. In the second embodiment, in the multiple-sheet recording processing, the controller 80 executes the processing along the flow of FIG. 6.

To provide more specific explanation, in the multiple-sheet recording processing of the second embodiment, the controller 80 firstly resets the variable N to 0 (zero) (step S401), resets a variable K to 1 (one) (step S402), and sets the allotment setting to the first setting (step S403).

Next, the controller 80 calculates, with respect to each of the plurality of nozzles 10, the total ejection amount E in a K-th setting (step S404). Next, the controller 80 executes a presuming processing which is similar to the processing in step S304, so as to presume, with respect to each of the plurality of nozzles 10, a point of time at which each of the plurality of nozzles 10 becomes the ejection-defective nozzle (step S405). Note that in the following description, an explanation will be given about such a case that a certain nozzle 10, of the plurality of nozzles 10, which is presumed to become the ejection-defective nozzle fastest among the plurality of nozzles 10 in the K-th setting, is presumed to become the ejection-defective nozzle during the recording of the same image on a $N_K$-th piece of the recording paper P.

Next, the controller 80 executes the recording processing so as to record the same image on one piece of the recording paper P (step S406); and the controller 80 increases the variable N by 1 (one) (step S407). In a case that the recording of the same image with respect to all the plurality of pieces of the recording paper P for which the recording is instructed is completed (step S408: YES), the controller 80 returns to the flow of FIG. 3A, and ends the processing.

In a case that the recording of the same image with respect to all the plurality of pieces of the recording paper P for which the recording is instructed is not completed (step S408: NO), the controller 80 determines whether or not a value [N+1] equals to $N_K$ (step S409). Namely, the controller 80 determines whether or not any one of the plurality of nozzles 10 is presumed to become the ejection-defective nozzle during the recording of the same image on next piece of the recording paper P. In a case that the value [N+1] is less than $N_K$ (step S409: NO), the controller 80 returns to the processing of step S406.

In a case that the value [N+1] equals to $N_K$ (step S409: YES), the controller 80 determines whether or not there is any changeable [K+1]-th setting, as the allotment setting (step S410). Here, the term "changeable [K+1]-th setting" means such a setting that is different from the first to K-th settings, and such an allotment setting in which the plurality of nozzles 10 are allotted with respect to the dots constructing the image to be recorded in the recording pass so that the total ejection amount E, of a certain nozzle 10, of the plurality of nozzles 10, which is presumed to become the ejection-defective nozzle fastest among the plurality of nozzles 10 in the Kth setting is presumed to become the ejection-defective nozzle, becomes greater than that in the K-th setting. Further, this determination is performed by the controller 80 based on the image data and the allotment of the plurality of nozzles 10 with respect to the plurality of dots constructing the image to be recorded in each of the first to K-th settings.

In a case that there is a changeable [K+1]-th setting (step S410: YES), the controller 80 changes the allotment setting to the [K+1]-th setting (step S411), updates the value of the variable K to [K+1] (step S412), and returns to the processing of step S404. In a case that there is not any changeable [K+1]-th setting (step S410: NO), the controller 80 returns to the processing of step S402.

Technical Effects of the Second Embodiment

In a case that the recording of the same image is performed continuously on a plurality of pieces of the recording paper P in the first setting, there is such a case that the controller 80 presumes that any one of (for example, a certain nozzle 10 included in) the plurality of nozzles 10 becomes the ejection-defective nozzle before the recording of the same image with respect to all the plurality of pieces of the recording paper P for which the recording is instructed is completed. In the second embodiment, in such a case, similarly to the first embodiment, the controller 80 changes the allotment setting to the second setting, before the point of time at which the certain nozzle 10 as any one of the plurality of nozzles 10 is presumed to become the ejection-defective nozzle. Further, in a case that recording of the same image is performed continuously on a plurality of pieces of the recording paper P in the second setting (the K-th setting in a case of K=2), there is such a case that the controller 80 presumes that any one of (for example, a certain nozzle 10 included in) the plurality of nozzles 10 becomes the ejection-defective nozzle before the recording of the same image with respect to all the plurality of pieces of the recording paper P for which the recording is instructed is completed. In such a case, the controller 80 changes the allotment setting to a third setting (the [K+1]-th setting in the case of K=2), before the point of time at which the certain nozzle 10 as any one of the plurality of nozzles 10 is presumed to become the ejection-defective nozzle, as another setting in which the total ejection amount E of the certain nozzle to be greater than that in the second setting. In the third setting, the allotment of the plurality of nozzles with respect to the dots, which construct the same image, in the recording pass is different from that in the second setting. With this, by changing the allotment setting, the allotment of the plurality of nozzles 10, for recording the same image, with respect to the dots constructing the same image in the recording pass is changed, thereby raising the using frequency of a nozzle 10, among the plurality of nozzles 10, which is low in the allotment setting before the change becomes high in the allotment setting after the change, and such a nozzle 10 is less likely to become the ejection-defective nozzle. As a result, there is no need to perform, for example, the suction purge for recovering the nozzles 10, thereby making it possible to shorten, as much as possible, the time since the recording instruction is input and until the recording is completed. Further, in the above-described case, in a case that the allotment setting is changed to the third setting, it is possible to prevent the using frequency of the certain nozzle 10, which has been low in the first setting before the change of the allotment setting, from becoming low again.

Third Embodiment

Figure 7:
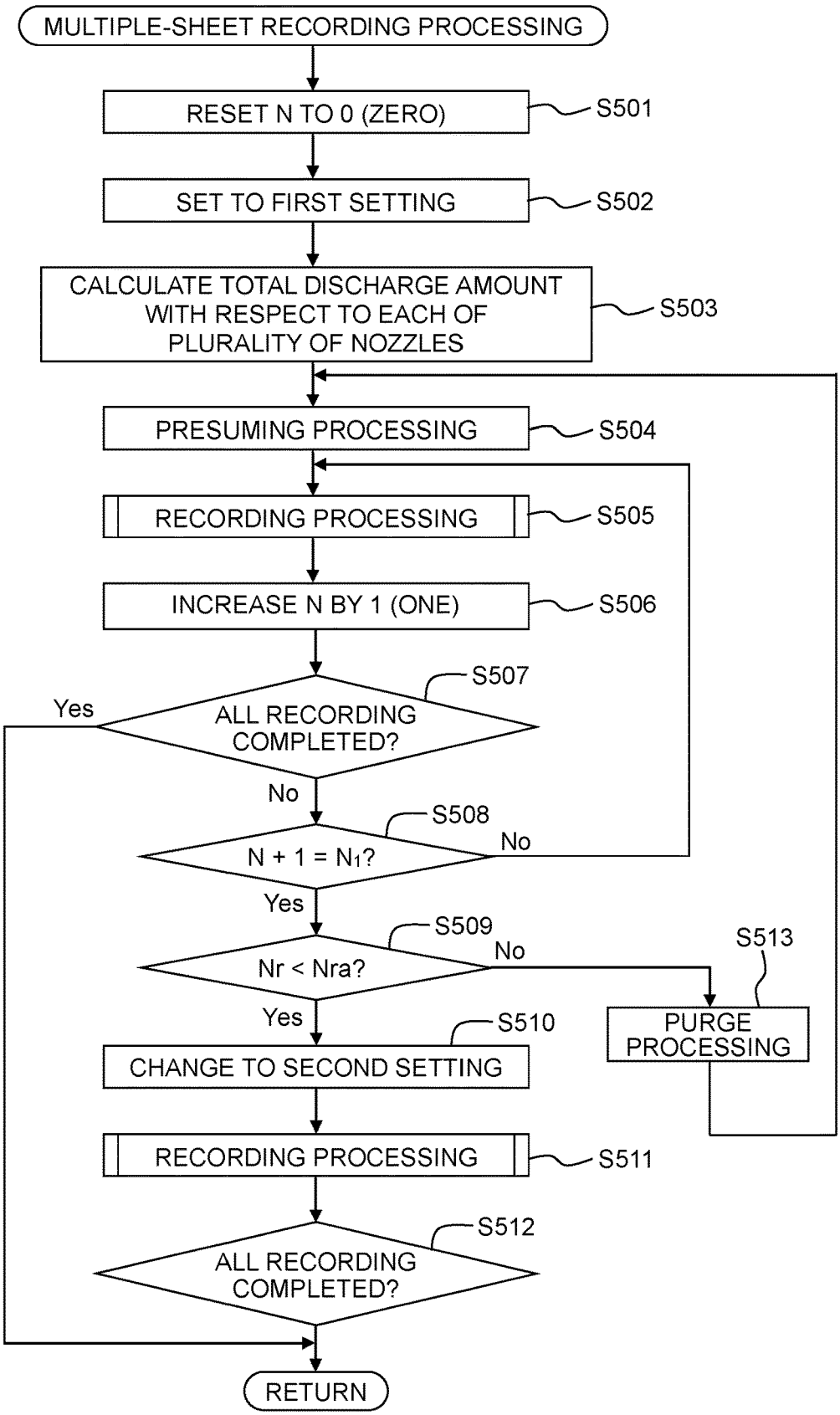
FIG. 7 is a flow chart depicting the flow of the multiple-sheet recording processing in a third embodiment.

Next, a third embodiment of the present disclosure will be explained. The third embodiment is different from the first and second embodiments, in view of the flow of the multiple-sheet recording processing. In the third embodiment, in the multiple-sheet recording processing, the controller 80 executes the processing along the flow of FIG. 7.

To provide more specific explanation, in the multiple-sheet recording processing of the third embodiment, the controller 80 executes processing of steps S501 to S507 which are similar to the processings of steps S301 to S307 of the first embodiment. Further, similarly to the first embodiment, in a case that a value [N+1] is less than $N_1$ (step S508: NO), the controller 80 returns to the processing of step S505. On the other hand, in a case that the value [N+1] equals to $N_1$ (step S508: YES), the controller 80 then determines whether or not a number (number of pieces or sheets) Nr of non-recorded recording paper P, for which the recording is not performed, is less than a predetermined number Nra (step S509).

In a case that the number Nr of the non-recorded recording paper P is less than the predetermined number Nra (step S509: YES), the controller 80 changes the allotment setting to the second setting (step S510). Then, until the recording of the same image with respect to the plurality of pieces of the recording paper P for which the recording is instructed is completed (step S512: NO), the controller 80 repeats the recording processing in the second setting (step S511); in a case that the recording of the same image with respect to the plurality of pieces of the recording paper P for which the recording is instructed is completed (step S512: YES), the controller 80 returns to the flow of FIG. 3A, and ends the processing.

On the other hand, in a case that the number Nr of the non-recorded recording paper P is not less than the predetermined number Nra (step S509: NO), the controller 80 executes a purge processing of performing the above-described suction purge (step S513), and returns to the processing of step S504.

Technical Effects of the Third Embodiment

In a case that the recording of the same image is performed continuously on a plurality of pieces of the recording paper P in the first setting, there is such a case that the controller 80 presumes that any one of (for example, a certain nozzle 10 included in) the plurality of nozzles 10 becomes the ejection-defective nozzle before the recording of the same image with respect to all the plurality of pieces of the recording paper P for which the recording is instructed is completed. Also in the third embodiment, similarly to the first embodiment, the controller 80 changes the allotment setting to the second setting, before the point of time at which the certain nozzle 10 as any one of the plurality of nozzles 10 is presumed to become the ejection-defective nozzle. With this, by changing the allotment setting, the allotment of the plurality of nozzles 10, for recording the same image, with respect to the dots constructing the same image in the recording pass is changed. Accordingly, the using frequency of a nozzle 10, among the plurality of nozzles 10, which is low in the first setting becomes high in the second setting, and such a nozzle 10 is less likely to become the ejection-defective nozzle. As a result, it is possible to make the frequency of performing the suction purge for recovering the nozzles 10 to be smaller as compared with another case wherein the same image is continuously recorded (on the plurality of pieces of the recording paper P) in the first setting, thereby making it possible to shorten, as much as possible, the time since the recording instruction is input and until the recording is completed.

Note that, however, in a case that the allotment setting is changed to the second setting, although the using frequency of a nozzle 10, included in the plurality of nozzles 10, which has been low during the printing of the image in the first setting becomes high, the using frequency of another nozzle 10 becomes low. Accordingly, in a case that the number of the non-recorded recording paper P is great at a point of time when the allotment setting is changed to the second setting, and that the image is recorded by changing the allotment setting to the second setting, there is such a possibility that a certain nozzle 10 of which using frequency becomes low in the second setting might become the ejection-defective nozzle before the recording of the same image with respect to all the plurality of pieces of the recording paper P for which the recording is instructed is completed.

In view of this situation, in the third embodiment, in a case that the number Nr of the non-recorded recording paper P is less than the predetermined number Nra at the point of time at which any one of (for example, a certain nozzle 10 included in) the plurality of nozzles 10 is presumed to become the ejection-defective nozzle under a condition that the same image is continuously recorded on the plurality of pieces of the recording paper P in the first setting, the controller 80 changes the allotment setting to the second setting. With this, the certain nozzle 10 of which using frequency becomes low in the second setting is less likely to become the ejection-defective nozzle. Note that in this case, the allotment setting is consequently changed to the second setting before that point of time at which the certain nozzle 10, of the plurality of nozzles 10, presumed to become the ejection-defective nozzle fastest among the plurality of nozzles 10 in the first setting, is presumed to become the ejection-defective nozzle, and at a point of time at which the number Nr of the non-recorded recording paper P is less than the predetermined number Nra.

Fourth Embodiment

Figure 8:
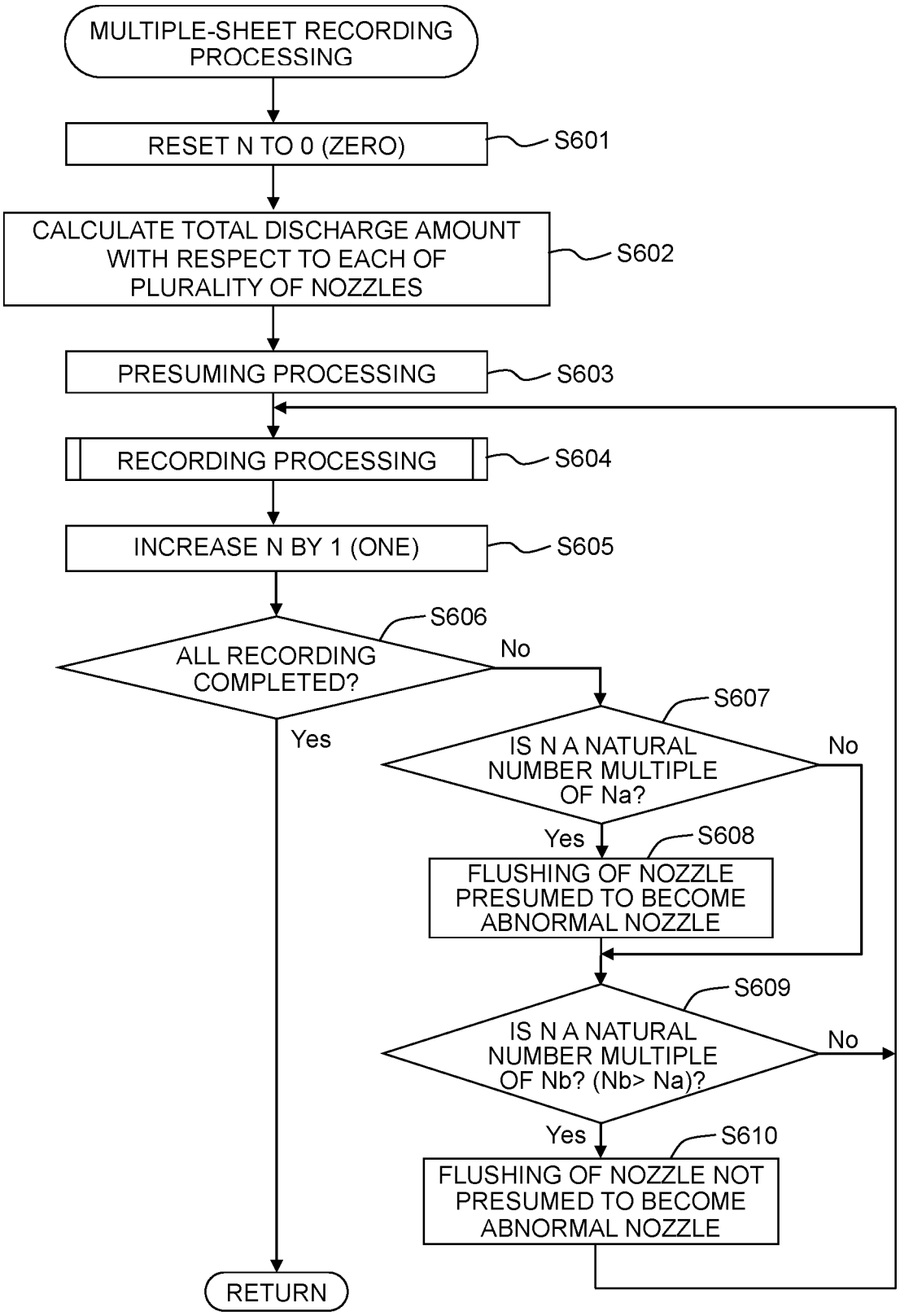
FIG. 8 is a flow chart depicting the flow of the multiple-sheet recording processing in a fourth embodiment.

Next, a fourth embodiment of the present disclosure will be explained. The fourth embodiment is different from the first to third embodiments, in view of the flow of the multiple-sheet recording processing. In the fourth embodiment, in the multiple-sheet recording processing, the controller 80 executes the processing along the flow of FIG. 8.

To provide more specific explanation, in the multiple-sheet recording processing of the fourth embodiment, the controller 80 firstly resets the variable N to 0 (zero) (step S601). Next, the controller 80 calculates, with respect to each of the plurality of nozzles 10, the total ejection amount E (step S602). Note that in the fourth embodiment, for example, the allotment setting is similar, for example, to the first setting of the first embodiment, and is not changed.

Next, the controller 80 executes a presuming processing (step S603). In the presuming processing, the controller 80 presumes, with respect to each of the plurality of nozzles 10, a point of time at which each of the plurality of nozzles 10 becomes the ejection-defective nozzle, based on: the total ejection amount E calculated in step S602, the temperature T obtained based on the signal from the temperature sensor 89, and the data of the table stored in the flash memory 84; and the controller 80 stores, in the flash memory 84, information regarding a certain nozzle 10, of the plurality of nozzles 10, which is presumed to become the ejection-defective nozzle before the recording of the same image with respect to all the plurality of pieces of the recording paper P for which the recording is instructed is completed.

Next, the controller 80 executes the recording processing so as to record the same image on one piece of the recording paper P (step S604); and the controller 80 increases the variable N by 1 (one) (step S605). In a case that the recording of the same image with respect to all the plurality of pieces of the recording paper P for which the recording is instructed is completed (step S606: YES), the controller 80 returns to the flow of FIG. 3A. In a case that the recording of the same image with respect to all the plurality of pieces of the recording paper P for which the recording is instructed is not completed (step S606: NO), the controller 80 then determines whether or not the variable N is a natural number multiple of a predetermined number Na (step S607). In a case that the variable N is not the natural number multiple of the predetermined number Na (step S607: NO), the controller 80 proceeds to a processing of step S609.

In a case that the variable N is the natural number multiple of the predetermined number Na (step S607: YES), the controller 80 drives the ink-jet head 4 in a state that the carriage 2 is positioned at the maintenance position, and performs flushing (corresponding to a "maintenance operation" of the present disclosure) of causing the ink to be discharged, toward the cap 61, from the certain nozzle 10, of the plurality of nozzles 10, which is presumed in step S603 to become the ejection-defective nozzle before the recording of the same image with respect to all the plurality of pieces of the recording paper P for which the recording is instructed is completed (step S608), and then the controller 80 proceeds to the processing of step S609. Note that in the fourth embodiment, the ink-jet head 4 configured to perform the flushing functions as the "head" and also as the "maintenance section" of the present disclosure.

In the processing of step S609, the controller 80 determines whether or not the variable N is a natural number multiple of a predetermined number Nb (Nb>Na). In a case that the variable N is not the natural number multiple of the predetermined number Nb (step S609: NO), the controller 80 returns to the processing of step S604.

In a case that the variable N is the natural number multiple of the predetermined number Nb (step S609: YES), the controller 80 drives the ink-jet head 4 in the state that the carriage 2 is positioned at the maintenance position, and performs flushing of causing the ink to be discharged, toward the cap 61, from nozzles 10, which are included in the plurality of nozzles 10 and which are different from the certain nozzle 10 presumed in step S603 to become the ejection-defective nozzle before the recording of the same image with respect to all the plurality of pieces of the recording paper P for which the recording is instructed is completed (step S610), and then the controller 80 returns to the processing of step S604.

Further, in the fourth embodiment, by the processings of steps S607 to S609, the flushing is performed every time the recording of the same image with respect to all Na pieces of the recording paper P for which the recording is instructed is completed, for the certain nozzle 10 presumed in step S603 to become the ejection-defective nozzle before the recording of the same image with respect to all the plurality of pieces of the recording paper P for which the recording is instructed is completed. For the nozzles 10, which are included in the plurality of nozzles 10 and which are different from the certain nozzle 10, the flushing is performed every time the recording of the same image with respect to Nb (>Na) pieces of the recording paper P is completed. Accordingly, the frequency of the flushing for the certain nozzle 10 presumed to become the ejection-defective nozzle before the recording of the same image with respect to all the plurality of pieces of the recording paper P for which the recording is instructed is completed is higher than the frequency of the flushing for the nozzles 10 different from the certain nozzle 10.

Technical Effects of the Fourth Embodiment

In the fourth embodiment, the flushing is performed during the recording of the same image with respect to the plurality of pieces of the recording paper P. Further, in a case that the same image is recorded continuously on the plurality of pieces of the recording paper P, the controller 80 calculates, with respect to each of the plurality of nozzles 10, the total ejection amount E; the controller presumes, with respect to each of the plurality of nozzles 10, the point of time at which each of the plurality of nozzles 10 becomes the ejection-defective nozzle, based on the calculated total ejection amount E and based on the data of the above-described table. The controller specifies, based on the results of the presumption of the point of time as described above, a certain nozzle 10, of the plurality of nozzles 10, which is presumed to become the ejection-defective nozzle before the recording of the same image with respect to all the plurality of pieces of the recording paper P for which the recording is instructed is completed. Further, the controller makes the frequency of the flushing to be higher for the certain nozzle 10 presumed to become the ejection-defective nozzle before the recording of the same image with respect to all the plurality of pieces of the recording paper P for which the recording is instructed is completed to be higher than the frequency of the flushing for the nozzles 10 different from the certain nozzle 10. With this, any one of the plurality of nozzles 10 is less likely to become the ejection-defective nozzle. Furthermore, it is possible to shorten the time since the recording instruction is input and until the recording is completed, as compared with another case wherein the frequency of the flushing is made to be uniformly high for all the plurality of pieces of the nozzles 10, and it is also possible to suppress an exhaust amount (discharge amount) of the ink by the flushing.

Fifth Embodiment

Figure 9:
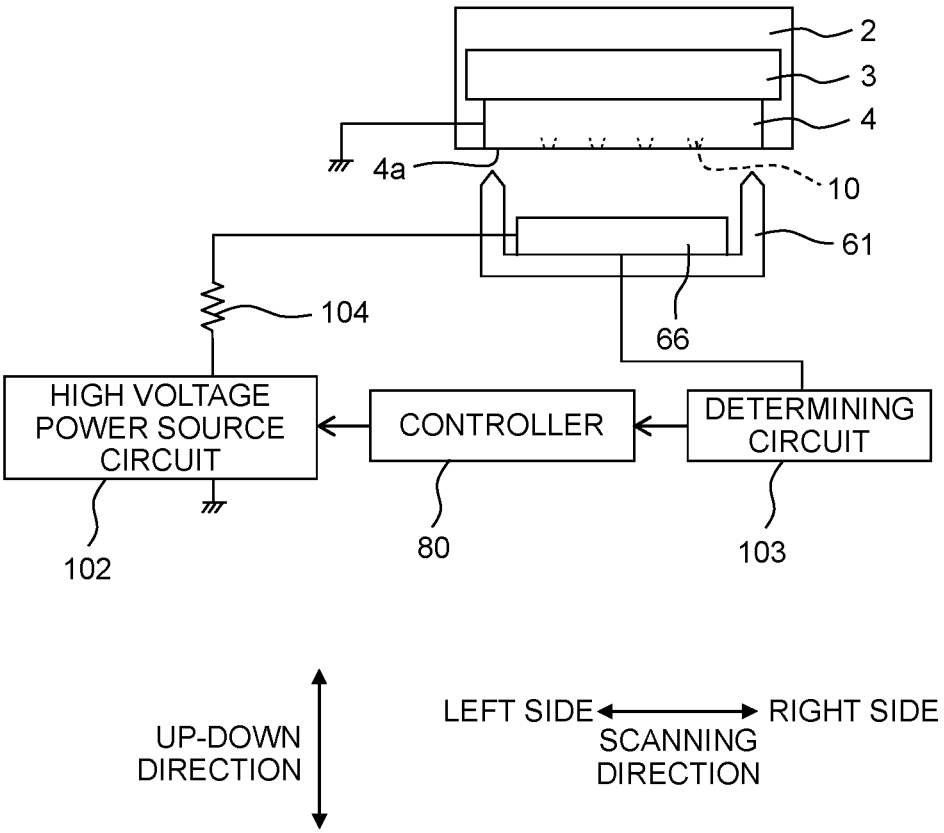
FIG. 9 is a view depicting a detecting electrode arranged inside a cap, and explaining the relationship of connection of the detecting electrode to a high voltage power source circuit and to a determining circuit.

Next, a fifth embodiment of the present disclosure will be explained. In the fifth embodiment, as depicted in FIG. 9, a detecting electrode 101 having a rectangular shape in a plane view is arranged inside the cap 61. The detecting electrode 101 is connected to a high voltage power source circuit 102 via a resistor 104. Further, a predetermined positive potential (for example, approximately 300 V) is imparted to the detecting electrode 101 by the high voltage power source circuit 102. On the other hand, the ink-jet head 4 is maintained at the ground potential. With this, there is generated a predetermined difference in the potential between the ink-jet head 4 and the detecting electrode 101. A determining circuit 103 is connected to the detecting electrode 101. The determining circuit 103 compares the voltage value of a voltage signal outputted from the detecting electrode 101 with a threshold value Vt, and outputs signals according to the result of the comparison.

Figure 10A:
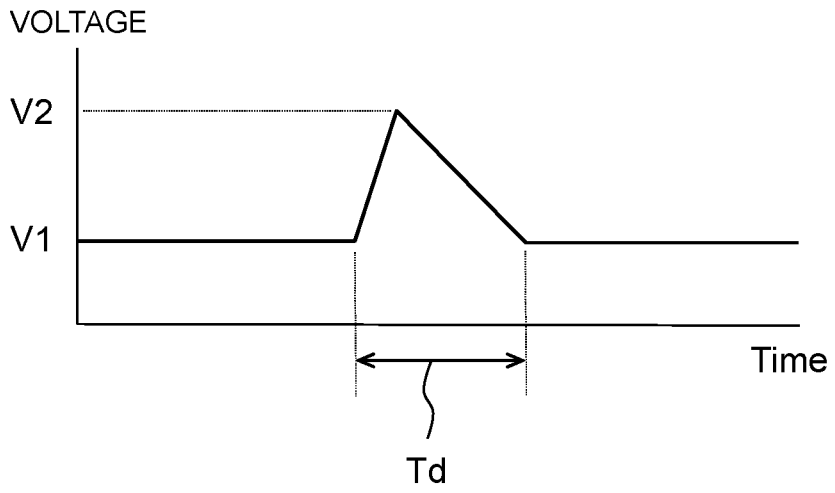
FIG. 10A is a view depicting a change in a voltage value of the detecting electrode in a case that ink is ejected from a nozzle.

To provide a more specific explanation, since the difference in the potential is generated between the ink-jet head 4 and the detecting electrode 101, the ink ejected from the nozzles 10 is charged with the electricity. As depicted in FIG. 10A, in a case that the ink or inks is/are ejected from the nozzles 10 toward the detecting electrode 101 in a state that the carriage 2 is positioned at the above-described maintenance position, the charged ink approaches closely to the detecting electrode 101. Accordingly, until the charged ink lands on the detecting electrode 101, the voltage value of the detecting electrode 101 is raised from a voltage value V1 in a state that the ink-jet head 4 is not driven and reaches voltage value V2 which is higher than the voltage value V1. Then, after the charged ink has landed on the detecting electrode 101, the voltage value of the detecting electrode 101 is lowered gradually from the voltage value V2 and returns to the voltage value V1. Namely, in a driving period Td during which the ink-jet head 4 is driven, the voltage value of the detecting electrode 101 changes.

Figure 10B:
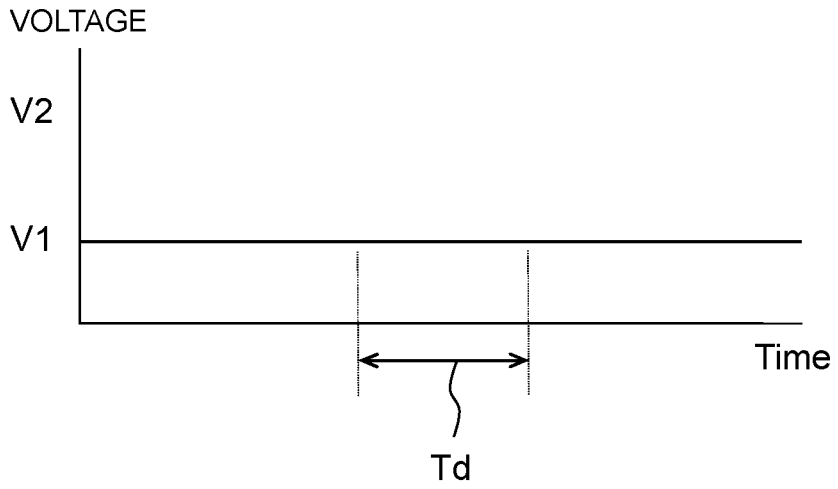
FIG. 10B is a view depicting the change in the voltage value of the detecting electrode in a case that the ink is not ejected from the nozzle.

On the other hand, in a case that the ink is not ejected from the nozzles 10, the voltage value of the voltage signal outputted from the detecting electrode 101 hardly changes from the voltage value V1 during the driving period Td of the ink-jet head 4, as depicted in FIG. 10B. In view of this, a threshold value Vt (V1<Vt<V2) is set in the determining circuit 103 so as to discriminate or distinguish these voltage values in the above two cases. Further, the determining circuit 103 compares a maximum voltage value of the voltage signal outputted from the detecting electrode 101 with the threshold value Vt during the driving period Td of the ink-jet head 4, and outputs a signal in accordance with the result of the determination. Note that in the fifth embodiment, the detecting electrode 101, the high voltage power source circuit 102, the resistor 104 and the determining circuit 103 are combined so as to collectively correspond to a "signal outputting circuit" of the present disclosure. Further, the signal outputting circuit is configured to output different signals depending on whether or not the ink is ejected from each of the plurality of nozzles 10.

Note that in this case, although the positive potential is imparted to the detecting electrode 101 by the high voltage power source circuit 102, it is also allowable that a negative potential (for example, approximately −300 V) is imparted to the detecting electrode 101 by the high voltage power source circuit 102. In such a case, contrary to the above-described case, the ink or inks is (are) ejected from the nozzles 10 toward the detecting electrode 101 in the state that the carriage 2 is positioned at the above-described maintenance position, then the voltage value of the detecting electrode 101 is lowered from the voltage value V1 while the charged ink approaches closely to the detecting electrode 101 and until the charged ink lands on the detecting electrode 101; after the ink has landed on the detecting electrode 101, the voltage value is raised gradually and returns to the voltage value V1.

Further, the signal from the determining circuit 103 is input to the controller 80. With this, information regarding as to whether or not the ink is ejected from each of the plurality of nozzles 10 (information regarding as to whether or not each of the plurality of nozzles 10 is the ejection-defective nozzle), based on the signal from the determining circuit 103, is input to the controller 80.

Figure 11:
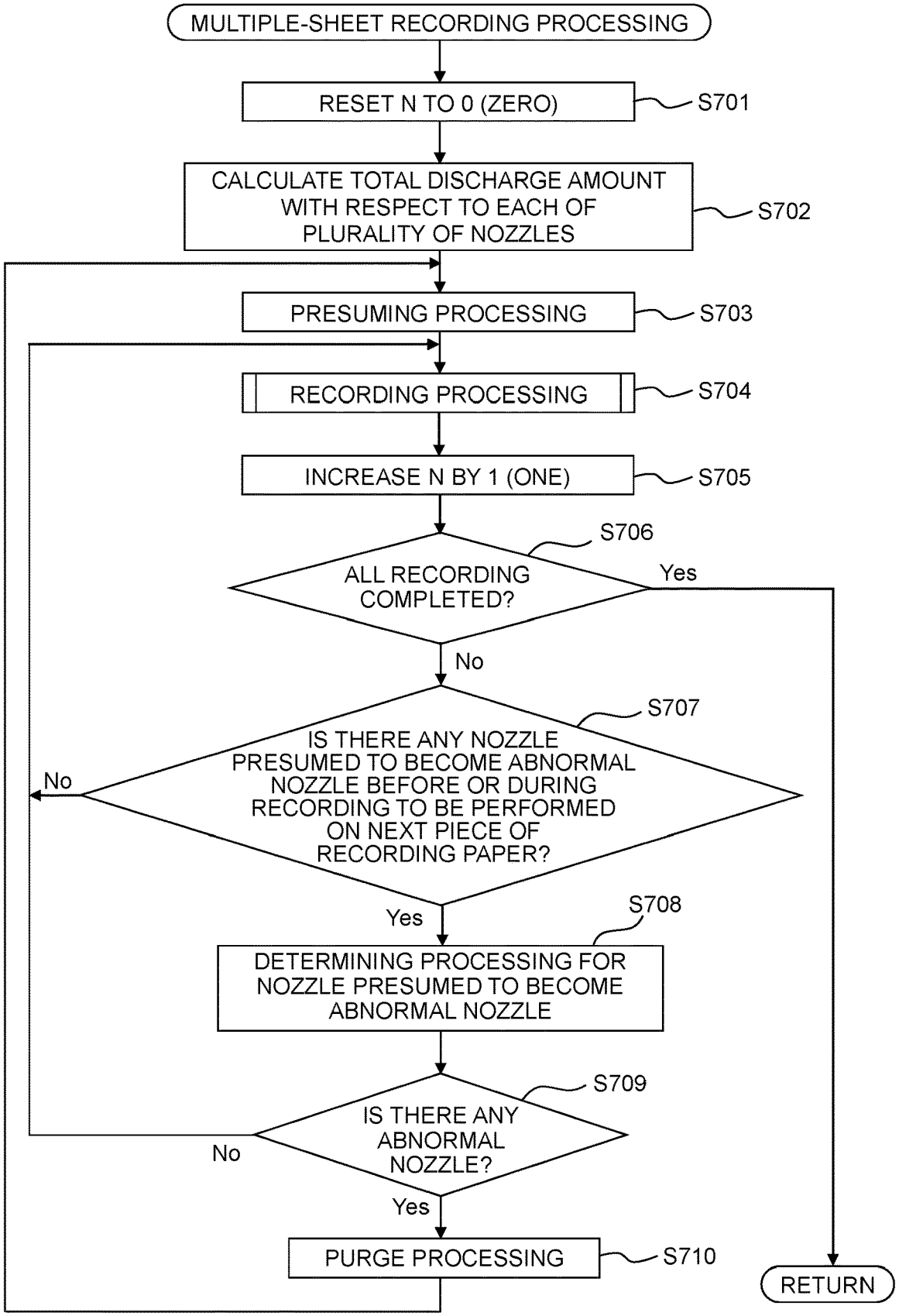
FIG. 11 is a flow chart depicting the flow of the multiple-sheet recording processing in the fifth embodiment.

Furthermore, in the fifth embodiment, in the multiple-sheet recording processing, the controller 80 executes the processing along the flow of FIG. 11.

To provide more specific explanation, in the multiple-sheet recording processing of the fifth embodiment, the controller 80 firstly resets the variable N to 0 (zero) (step S701). Next, the controller 80 calculates, with respect to each of the plurality of nozzles 10, the total ejection amount E (step S702). Note that in the fifth embodiment, for example, the allotment setting is similar to the first setting of the first embodiment, and is not changed.

Next, the controller 80 executes a presuming processing (step S703). In the presuming processing, the controller 80 presumes, with respect to each of the plurality of nozzles 10, a point of time at which each of the plurality of nozzles 10 becomes the ejection-defective nozzle, based on: the total ejection amount E calculated in step S702, the temperature T obtained based on the signal from the temperature sensor 89, and the data of the table stored in the flash memory 84; and the controller 80 stores, in the flash memory 84, information, regarding each of the plurality of nozzles 10, about a point of time at which each of the plurality of nozzles 10 is presumed to become the ejection-defective nozzle before the recording of the same image with respect to all the plurality of pieces of the recording paper P for which the recording is instructed is completed.

Next, the controller 80 executes the recording processing so as to record the same image on one piece of the recording paper P (step S704); and the controller 80 increases the variable N by 1 (one) (step S705). In a case that the recording of the same image with respect to all the plurality of pieces of the recording paper P for which the recording is instructed is completed (step S706: YES), the controller 80 returns to the flow of FIG. 3A, and ends the processing. In a case that the recording of the same image with respect to all the plurality of pieces of the recording paper P for which the recording is instructed is not completed (step S706: NO), the controller 80 then determines whether or not there is a nozzle 10, among the plurality of nozzles 10, which is presumed to become the ejection-defective nozzle 10 during or before recording of a next recording paper P ([N+1]-th recording paper P) (step S707).

In a case that there is not such a nozzle 10 (step S707: NO), the controller 80 returns to the processing of step S704. In a case that there is such a nozzle 10 (step S707: YES), the controller 80 then executes the determining processing with respect to the nozzle 10, among the plurality of nozzles 10, which is presumed to become the ejection-defective nozzle 10 during or before recording of the next recording paper P (step S708). In the determining processing, the controller 80 drives the ink-jet head 4 so as to eject the ink from each of nozzle(s) 10, which is presumed to become the ejection-defective nozzle, toward the detecting electrode 101, and determines whether or not the nozzle(s) 10 is (are) actually the ejection-defective nozzle, based on the signal outputted from the determining circuit 103 in this situation.

Then, in a case that there is not any ejection-defective nozzle as a result of the determining processing of step S708 (step S709: NO), the controller 80 returns to the processing of step S704; in a case that there is an ejection-defective nozzle as the result of the determining processing of step S708 (step S709: YES), the controller 80 executes the purge processing of causing the above-described suction purge to be performed (step S710), and returns to the processing of step S703.

Technical Effects of the Fifth Embodiment

In the fifth embodiment, the controller 80 calculates the total ejection amount E with respect to each of the plurality of nozzles 10. Then, the controller 80 presumes the point of time at which each of the plurality of nozzles 10 becomes the ejection-defective nozzle, based on the calculated total ejection amount E, and based on the data of the above-described table. Further, the controller 80 executes the determining processing, with respect to a certain nozzle, which is included in the plurality of nozzles and which is presumed to become the ejection-defective nozzle before the recording of the same image with respect to all the plurality of pieces of the recording paper P for which the recording is instructed is completed, of determining whether or not the certain nozzle has actually become the ejection-defective nozzle, before the point of time at which the certain nozzle is presumed to become the ejection-defective nozzle. With this, the controller 80 is capable of determining whether or not the nozzle 10 is the ejection-defective nozzle only with respect to a nozzle 10, among the plurality of nozzles 10, which is highly likely to actually or already become the ejection-defective nozzle. With this, it is possible to shorten, as much as possible, the time since the recording instruction is input and until the recording is completed, as compared with another case wherein the all the plurality of nozzles 10 are uniformly subjected to the determination as to whether or not each of the plurality of nozzle 10 is the ejection-defective nozzle.

Modified Embodiment

In the foregoing, the first to fifth embodiments of the present disclosure have been explained. The present disclosure, however, is not limited to or restricted by the first to fifth embodiments; it is allowable to make a various kind of changes to the present disclosure, within the scope described in the claims.

In the first embodiment, in a case that a certain nozzle 10 which is presumed to become the ejection-defective nozzle fastest among the plurality of nozzles 10 in the first setting is presumed to become the ejection-defective nozzle during the recording of the same image on the $N_1$-th piece of the recording paper P, the controller 80 changes the allotment setting to the second setting immediately before the recording is performed for the $N_1$-th piece of the recording paper P. The aspect of the present disclosure, however, is not limited to this. For example, it is allowable that the controller 80 changes the allotment setting to the second setting at a point of time which is prior to immediately before the recording is performed for the $N_1$-th piece of the recording paper P, such as, for example, immediately before the recording is performed for the $[N_1-1]$-th piece of the recording paper P.

Further, in the first embodiment, in a case that a certain nozzle 10 which is presumed to become the ejection-defective nozzle fastest among the plurality of nozzles 10 in the second setting is presumed to become the ejection-defective nozzle during the recording of the same image on the $N_2$-th piece of the recording paper P, the controller 80 changes the allotment setting to the first setting immediately before the recording is performed for the $N_2$-th piece of the recording paper P. The aspect of the present disclosure, however, is not limited to this. For example, it is allowable that the controller 80 changes the allotment setting to the first setting at a point of time which is prior to immediately before the recording is performed for the $N_2$-th piece of the recording paper P, such as, for example, immediately before the recording is performed for the $[N_2-1]$-th piece of the recording paper P.

In the second embodiment, in a case that a certain nozzle 10 which is presumed to become the ejection-defective nozzle fastest among the plurality of nozzles 10 in the K-th setting is presumed to become the ejection-defective nozzle during the recording of the same image on the $N_K$-th piece of the recording paper P, that the controller 80 changes the allotment setting immediately before the recording is performed for the $N_K$-th piece of the recording paper P. The aspect of the present disclosure, however, is not limited to this. For example, it is allowable that the controller 80 changes the allotment setting at another point of time which is prior to immediately before the recording is performed for the $N_K$-th piece of the recording paper P, such as, for example, immediately before the recording is performed for the $[N_K-1]$-th piece of the recording paper P.

In the third embodiment, in a case that a certain nozzle 10 which is presumed to become the ejection-defective nozzle fastest among the plurality of nozzles 10 in the first setting is presumed to become the ejection-defective nozzle during the recording of the same image on the $N_1$-th piece of the recording paper P, and in a case that the number Nr of the non-recorded recording paper P is less than the predetermined number Nra immediately before the recording is performed for the $N_1$-th piece of the recording paper P, the controller 80 changes the allotment setting to the second setting immediately before the recording is performed for the $N_1$-th piece of the recording paper P. The aspect of the present disclosure, however, is not limited to this. For example, it is allowable that the controller 80 changes the allotment setting to the second setting at another point of time which is prior to immediately before the recording is performed for the $N_1$-th piece of the recording paper P and at which the number Nr of the non-recorded recording paper P is less than the predetermined number Nra.

Further, in the first to third embodiments, the controller 80 changes the allotment setting immediately before the recording is performed for any one of the plurality of pieces of the recording paper P, based on the result of the presuming processing. The aspect of the present disclosure, however, is not limited to this. It is allowable, for example, that the controller 80 changes the allotment setting during the recording performed for any one of the plurality of pieces of the recording paper P, based on the result of the presuming processing.

Further, in the fourth embodiment, the controller 80 performs the flushing every time the recording of the same image with respect to Na pieces of the recording paper P is completed, for the certain nozzle 10 presumed to become the ejection-defective nozzle before the recording of the same image with respect to all the plurality of pieces of the recording paper P for which the recording is instructed is completed; and the controller 80 performs the flushing every time the recording of the same image with respect to Nb (>Na) pieces of the recording paper P is completed, for the nozzles 10, which are included in the plurality of nozzles 10 and which are different from the certain nozzle 10. The aspect of the present disclosure, however, is not limited to this.

For example, such a case is assumed wherein it is possible to perform suction of the ink with respect to nozzles, as a part of a plurality of nozzles constructing a plurality of nozzle rows, of which positions in a nozzle alignment direction are same to each other, as in a vacuum wiper described in Japanese Patent Application Laid-open No. 2019-14155. In such a case, the controller 80 may perform the suction of the ink every time the recording of the same image with respect to Na pieces of the recording paper P for which the recording is instructed is completed, for a nozzle 10 which is included in the nozzles constructing the four nozzle rows 9 and of which direction in the nozzle alignment direction is same as that of the certain nozzle 10 presumed to become the ejection-defective nozzle before the recording of the same image with respect to all the plurality of pieces of the recording paper P for which the recording is instructed is completed; and the controller 80 may perform the suction of the ink every time the recording of the same image with respect to Nb (>Na) pieces of the recording paper P is completed, for a nozzle 10 which is included in the nozzles constructing the four nozzle rows 9 and of which direction in the nozzle alignment direction is not same as that of the certain nozzle 10. The disclosure of Japanese Paten Application Laid-open No. 2019-14155 is incorporated herein by reference in its entirety.

Alternatively, for example, it is allowable that the controller 80 performs the flushing every time the recording pass is performed for Ja number of times for the certain nozzle 10, which is presumed to become the ejection-defective nozzle before the recording of the same image with respect to all the plurality of pieces of the recording paper P for which the recording is instructed is completed, and that the controller 80 performs the flushing every time the recording pass is performed for a Jb number of time (Jb>Ja) for the nozzles 10 which are included in the plurality of nozzles 10 and which are different from the certain nozzle 10.

Further, in the fifth embodiment, the signals indicating whether or not a certain nozzle 10, among the plurality of nozzles 10, is the ejection-defective nozzle is outputted from the determining circuit 130, depending on the voltage value of the detecting electrode 101 in the case that the ink is ejected from the certain nozzle 10 toward the detecting electrode 101. The aspect of the present disclosure, however, is not limited to this.

For example, it is allowable to arrange a detecting electrode extending in the up-down direction, and to cause the determining circuit to output a signal regarding whether or not the certain nozzle is the ejection-defective nozzle, depending on the a voltage value of the detecting electrode in a case that the ink is ejected from the certain nozzle 10 so that the ejected ink passes through an area facing the detecting electrode. Alternatively, it is allowable to provide an optical sensor which detects the ink ejected from the certain nozzle 10, and to cause the optical sensor to output a single regarding whether or not the certain nozzle is an ejection defective nozzleejection-defective nozzle.

Still alternatively, it is allowable to connect a voltage detecting circuit (corresponding to a "signal outputting circuit" of the present disclosure), which detects the change in voltage in a case that the ink is ejected from the nozzle, to a plate of the ink-jet head in which the nozzles are formed, and to cause the voltage detecting circuit to output, to the controller 80, a signal regarding whether or not the nozzle 10 is the ejection-defective nozzleejection defective nozzle, in a similar manner as described in Japanese Patent No. 4,929,699. The disclosure of Japanese Patent No. 4,929,699 is incorporated herein by reference in its entirety.

Yet still alternatively, it is allowable that a substrate of the ink-jet head is provided with a temperature detecting element (corresponding to the "signal outputting circuit" of the present disclosure), in a similar manner as described in Japanese Patent No. 6,231,759. Further, after a first application voltage is applied to thereby drive a heater so as to eject the ink, a second application voltage is applied to thereby drive the heater so as not to allow the ink to be ejected, and then to output a signal regarding whether or not the nozzle 10 is the ejection-defective nozzle, based on the change in the temperature detected by the temperature detecting element during a period since the application of the second voltage and until a predetermined time elapses. The disclosure of Japanese Patent No. 6,231,759 is incorporated herein by reference in its entirety.

Further, in the above-described embodiments, the suction purge is performed as the purge. The aspect of the present disclosure, however, it not limited to this. For example, it is allowable to provide a pressure pump at an intermediate part of the tubes 13 connecting the sub tank 3 to the ink cartridges 15. Alternatively, it is allowable that the printer is provided with a pressure pump which is connected to the ink cartridges. Further, it is allowable to drive the pressure pump in a state that the plurality of nozzles 10 are covered by the cap 61 to thereby perform a so-called pressure purge of pressurizing the ink inside the ink-jet head 4 and of discharging the ink inside the ink-jet head 4 from the nozzles 10. Note that in a case that the pressure purge is performed in the purge processing of the third embodiment, the cap 61 and the pressure pump are combined so as to collectively correspond to the "maintenance section" of the present disclosure.

Further, in the purge, it is allowable to perform both of the suction by the suction pump 62 and the pressurization by the pressure pump. Note that in such a case that both of the suction by the suction pump 62 and the pressurization by the pressure pump are performed in the purge processing of the third embodiment, the maintenance unit 8 and the pressure pump are combined so as to collectively correspond to the "maintenance section" of the present disclosure.

Furthermore, in the first to fifth embodiments, the flash memory 84 stores the data of the table in which the total ejection amount E and the temperature T, and the change amount of the change in viscosity of the ink in each of the plurality of nozzles 10 in the case of recording the same image on one piece of the recording paper P are associated with one another. However, the data storable in the flash memory 84 is not limited to this. For example, it is allowable that the flash memory 84 stores data of a table in which the total ejection amount E and another parameter regarding a usage environment (service condition) of the printer 1 such as the humidity, etc., and the above-described change amount of the change in viscosity are associated with each other. Alternatively, it is allowable that the flash memory 84 stores data of a table in which the total ejection amount E and the above-described change amount of the change in viscosity are associated with each other in one-to-one correspondence, regardless of the usage environment of the printer 1.

Furthermore, although the foregoing explanation has been given about the example wherein the present disclosure is applied to the printer which ejects the ink from the nozzles to thereby perform recording on the recording paper P, the application of the present disclosure is not limited to this. For example, it is also possible to apply the present disclosure to an image recording apparatus which is configured to record an image on a recording medium different from the recording paper, such as a T-shirt, a sheet for outdoor advertisement, a case for portable terminal such as a smartphone, corrugated cardboard, a resin member, etc.

What is claimed is:

1. An image recording apparatus comprising:

a conveyor configured to convey a recording medium in a conveyance direction;

a head in which a plurality of nozzles aligned in the conveyance direction are opened;

a carriage mounting the head and configured to move in a scanning direction crossing the conveyance direction; and a controller configured to execute:

recording of an image on the recording medium by performing a recording pass of causing the head to eject a liquid from the plurality of nozzles toward the recording medium while causing the carriage to move in the scanning direction, and a conveying operation of causing the conveyor to convey the recording medium in the conveyance direction;

in a case of performing recording of a same image continuously on a plurality of pieces of the recording medium, performing the recording of the same image by setting allotment of the plurality of nozzles with respect to dots constructing the same image in the recording pass and a conveyance amount of the recording medium in the conveyance operation to a first setting;

calculating, with respect to each of the plurality of nozzles, of a total ejection amount being a total of an ejection amount of the liquid from each of the plurality of nozzles in a case that the same image is recorded on one piece of the recording medium in the first setting;

presuming, with respect to each of the plurality of nozzles, of a point of time at which each of the plurality of nozzles becomes an ejection-defective nozzle having defectiveness in ejection of the liquid, based on the calculated total ejection amount, and based on data regarding a relationship between the total ejection amount and change in viscosity of the liquid in each of the plurality of nozzles; and in a case that the controller presumes that a certain nozzle as any one of the plurality of nozzles becomes the ejection-defective nozzle before the recording of the same image with respect to all the plurality of pieces of the recording medium for which the recording is instructed is completed, changing the allotment of the plurality of nozzles and the conveyance amount of the recording medium to a second setting, before the point of time at which the certain nozzle is presumed to become the ejection-defective nozzle, the second setting being different from the first setting in the allotment of the plurality of nozzles with respect to the dots, which construct the same image, in the recording pass so as to make the total ejection amount of the certain nozzle to be greater than that in the first setting.

2. The image recording apparatus according to claim 1, wherein in a case that the controller changes the allotment of the plurality of nozzles and the conveyance amount of the recording medium to the second setting, the controller is configured to execute:

calculating, with respect to each of the plurality of nozzles, of the total ejection amount in a case that the same image is recorded on one piece of the recording medium in the second setting;

presuming, with respect to each of the plurality of nozzles, of the point of time at which each of the plurality of nozzles becomes the ejection-defective nozzle, based on the calculated total ejection amount and on the data; and in a case that the controller presumes that the certain nozzle as any one of the plurality of nozzles becomes the ejection-defective nozzle before the recording of the same image with respect to all the plurality of pieces of the recording medium for which the recording is instructed is completed, changing the allotment of the plurality of nozzles and the conveyance amount of the recording medium to another setting, before the point of time at which the certain nozzle is presumed to become the ejection-defective nozzle, the another setting being different from the second setting in the allotment of the plurality of nozzles with respect to the dots, which construct the same image, in the recording pass so as to make the total ejection amount of the certain nozzle to be greater than that in the second setting.

3. The image recording apparatus according to claim 2, wherein the another setting is the first setting.

4. The image recording apparatus according to claim 2, wherein the another setting is a third setting which is different from both of the first setting and the second setting.

5. The image recording apparatus according to claim 1, wherein in a case that the controller presumes that the certain nozzle as any one of the plurality of nozzles becomes the ejection-defective nozzle before the recording of the same image with respect to all the plurality of pieces of the recording medium for which the recording is instructed is completed, and that a number of non-recorded recording medium, for which the recording is not performed, is less than a predetermined number at the point of time at which the certain nozzle as any one of the plurality of nozzles is presumed to become the ejection-defective nozzle, the controller is configured to execute the changing of the setting to the second setting, before the point of time at which the certain nozzle is presumed to become the ejection-defective nozzle, and at a certain point of time at which the number of the non-recorded recording medium is less than the predetermined number.

* * * * *